US007068961B2

(12) United States Patent
Shiraki et al.

(10) Patent No.: US 7,068,961 B2
(45) Date of Patent: Jun. 27, 2006

(54) DEVELOPING DEVICE, IMAGE FORMING APPARATUS, IMAGE FORMING SYSTEM, SEALING MEMBER, AND METHOD FOR MANUFACTURING SEALING MEMBER

(75) Inventors: Takayuki Shiraki, Nagano-ken (JP); Katsumi Okamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 10/902,705

(22) Filed: Jul. 29, 2004

(65) Prior Publication Data

US 2005/0047817 A1 Mar. 3, 2005

(30) Foreign Application Priority Data

Aug. 20, 2003 (JP) ..... 2003-296754
Sep. 26, 2003 (JP) ..... 2003-336087

(51) Int. Cl.
*G03G 15/08* (2006.01)

(52) U.S. Cl. ..... 399/103; 399/105; 399/119; 399/102

(58) Field of Classification Search ..... 399/102, 399/103, 105, 119
See application file for complete search history.

(56) References Cited

U.S. PATENT DOCUMENTS 5,134,960 A * 8/1992 Shirai ..... 399/105
5,740,499 A * 4/1998 Higeta et al. ..... 399/105
5,878,307 A * 3/1999 Greenlaw et al. ..... 399/106
6,144,820 A * 11/2000 Ishii et al. ..... 399/90
6,185,392 B1 * 2/2001 Hoshi ..... 399/102
6,615,006 B1 * 9/2003 Michlin et al. ..... 399/90
2001/0021318 A1 * 9/2001 Hashimoto et al. ..... 399/103
2003/0095804 A1 * 5/2003 Tanaka et al. ..... 399/13

FOREIGN PATENT DOCUMENTS

| | | |
|---|---|---|
| JP | 05-273848 | 10/1993 |
| JP | 11-073017 | 3/1999 |
| JP | 2000-029310 | 1/2000 |
| JP | 2000-075648 | 3/2000 |
| JP | 2001-060038 | 3/2001 |
| JP | 2002-278425 | 9/2002 |

* cited by examiner

*Primary Examiner*—David Gray
*Assistant Examiner*—Ryan D. Walsh
(74) *Attorney, Agent, or Firm*—Hogan & Hartson LLP

(57) ABSTRACT

A developing device includes: a developer container for containing developer; a developer bearing body for bearing the developer; a charging member for charging the developer bore by the developer bearing body by abutting against the developer bearing body; a supporting member for supporting the charging member; and a sealing member that is for preventing the developer from spilling from the developer container and that is provided in a state in which the side of one end thereof is compressed by the developer container and the charging member and the side of the other end thereof is compressed by the developer container and the supporting member, wherein a degree of compression of the sealing member on the side of the other end is smaller than a degree of compression of the sealing member on the side of one end.

11 Claims, 21 Drawing Sheets

DEVELOPING DEVICE, IMAGE FORMING APPARATUS, IMAGE FORMING SYSTEM, SEALING MEMBER, AND METHOD FOR MANUFACTURING SEALING MEMBER

CROSS-REFERENCE TO RELATED APPLICATIONS

The present application claims priority upon Japanese Patent Application No. 2003-296754 filed Aug. 20, 2003 and Japanese Patent Application No. 2003-336087 filed Sep. 26, 2003, which are herein incorporated by reference.

BACKGROUND OF THE INVENTION

1. Field of the Invention

The present invention relates to developing devices, image forming apparatuses, image forming systems, sealing members, and methods for manufacturing sealing members.

2. Description of the Related Art (1) There are known developing devices having, for example, a developer container for containing developer, a developer bearing body for bearing the developer, a charging member for charging the developer bore by the developer bearing body by abutting against the developer bearing body, a supporting member for supporting the charging member, and a sealing member that is for preventing the developer from spilling from the developer container and that is provided in a state in which the side of one end thereof is compressed by the developer container and the charging member and the side of the other end thereof is compressed by the developer container and the supporting member. (See, for example, JP 2001-60038 A.)

In developing devices structured as above, when, for example, the sealing member is compressed evenly and sufficiently across the whole distance from the side of one end to the other in order to appropriately prevent developer from spilling from the developer container, the following problem may arise. Since the compression-repulsion force of the sealing member causes a force to be applied to the supporting member at the side of the other end, this force may cause the supporting member to bend. Bending of the supporting member may cause the charging member supported by the supporting member to bend. Then, due to the bending of the charging member, the pressing force from the charging member to the developer bearing body may become uneven.

(2) Further, there are known image forming apparatuses having, for example, an image bearing body for bearing a latent image, and a developing device for developing the latent image bore by the image bearing body with developer. When these image forming apparatuses receive image signals etc. from an external device such as a host computer, it positions the developing device at a developing position that is in opposition to the image bearing body. The image forming apparatus develops the latent image bore by the image bearing body with the developer contained in the developing device, thus forming a developer image. The image forming apparatus then transfers the developer image onto a medium, thereby forming an image on the medium.

Further, such image forming apparatuses are provided with sealing members for preventing the developer from spilling. (See, for example, JP 2001-60038 A described above.)

Conventionally, urethane foam has often been used as the sealing member for preventing the developer from spilling. With urethane foam, however, the developer cannot be prevented from spilling in some circumstances. That is, since the size of the cells (air pockets) of urethane foam, which is one type of foam, is large and the walls between cells are thick, the developer may pass through the cells and spill from the sealing member if, for example, an unexpected impact is applied to the urethane foam.

SUMMARY OF THE INVENTION

The present invention has been made in view of the above and other problems, and an object thereof is to make the pressing force from the charging member to the developer bearing body even. Another object of the present invention is to prevent developer from spilling from the sealing member.

An aspect of the present invention is a developing device comprising: a developer container for containing developer; a developer bearing body for bearing the developer; a charging member for charging the developer bore by the developer bearing body by abutting against the developer bearing body; a supporting member for supporting the charging member; and a sealing member that is for preventing the developer from spilling from the developer container and that is provided in a state in which the side of one end thereof is compressed by the developer container and the charging member and the side of the other end thereof is compressed by the developer container and the supporting member, wherein a degree of compression of the sealing member on the side of the other end is smaller than a degree of compression of the sealing member on the side of one end.

Another aspect of the present invention is a sealing member for preventing developer from spilling, comprising a foam obtained by foaming a mixture including at least rubber and a foaming agent.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein.

DETAILED DESCRIPTION OF THE INVENTION

Figure 1:
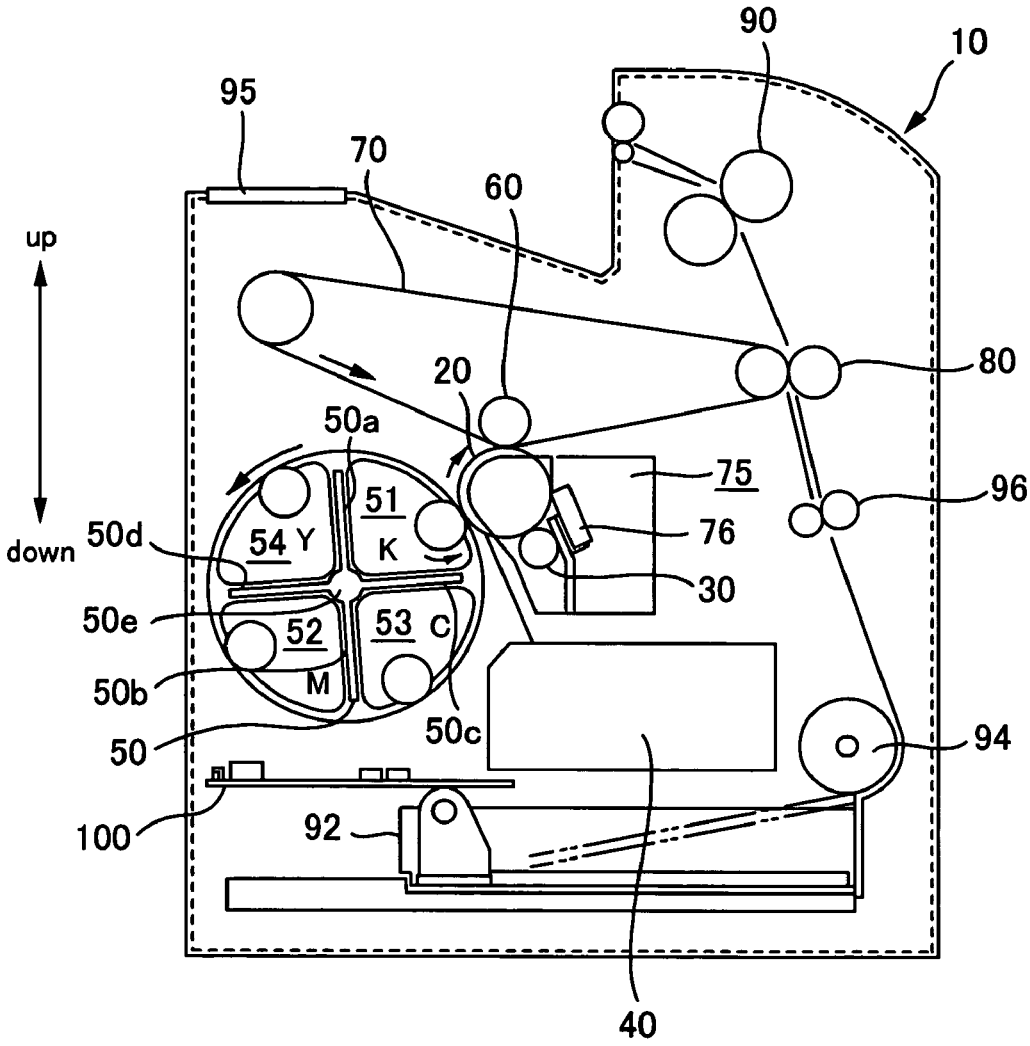
FIG. 1 is a diagram showing main structural components that structure a printer 10.

At least the following matters will be made clear by the explanation in the present specification and the description of the accompanying drawings.

(1) An aspect of the present invention is a developing device comprising: a developer container for containing developer; a developer bearing body for bearing the developer; a charging member for charging the developer bore by the developer bearing body by abutting against the developer bearing body; a supporting member for supporting the charging member; and a sealing member that is for preventing the developer from spilling from the developer container and that is provided in a state in which the side of one end thereof is compressed by the developer container and the charging member and the side of the other end thereof is compressed by the developer container and the supporting member, wherein a degree of compression of the sealing member on the side of the other end is smaller than a degree of compression of the sealing member on the side of one end.

According to such a developing device, since the degree of compression of the sealing member on the side of the other end is smaller than the degree of compression of the sealing member on the side of one end, it becomes possible to make the pressing force from the charging member to the developer bearing body even.

Further, in this developing device, the rigidity of the supporting member may be smaller than the rigidity of the developer container at a position corresponding to the side of the other end of the sealing member.

In such a situation, at the position corresponding to the side of the other end of the sealing member, the bending caused by the compression-repulsion force of the sealing member is likely to occur in the supporting member rather than the developer container, and thus, the pressing force from the charging member to the developer bearing body may become uneven. Therefore, the above-mentioned effect, that is, the effect of being able to make the pressing force from the charging member to the developer bearing body even, is achieved more advantageously.

Further, in this developing device, the supporting member may be fixed to the developing device at both ends of the supporting member in its longitudinal direction.

In such a situation, the bending caused by the compression-repulsion force of the sealing member is likely to occur in the central section, in the longitudinal direction, of the supporting member, and thus, the pressing force from the charging member to the developer bearing body may become uneven. Therefore, the above-mentioned effect, that is, the effect of being able to make the pressing force from the charging member to the developer bearing body even, is achieved more advantageously.

Further, in this developing device, the charging member may include an elastic section and a supporting section that supports the elastic section at the side of one end thereof and that has a fulcrum of flexure on the side of the other end thereof; the supporting member may support the supporting section at the side of the other end; and the supporting section may bend, with the fulcrum of flexure acting as a fulcrum, to make the elastic section abut against the developer bearing body at an abutting section and to charge the developer bore by the developer bearing body.

In the developing device having such a structure, the charging member uses the bending of the supporting section to apply the pressing force against the developer bearing body. Therefore, the above-mentioned effect, that is, the effect of being able to make the pressing force from the charging member to the developer bearing body even, is achieved more advantageously.

Further, in this developing device, the supporting section may be fixed to the supporting member at a predetermined fixing point; and the fixing point may serve as the fulcrum of flexure.

In the developing device having such a structure, the charging member uses the bending of the supporting section to apply the pressing force against the developer bearing body. Therefore, the above-mentioned effect, that is, the effect of being able to make the pressing force from the charging member to the developer bearing body even, is achieved more advantageously.

Further, in this developing device, the sealing member may be provided, on a side of the charging member opposite from the side of the developer bearing body, extending at least from a position corresponding to the fulcrum of flexure to a position corresponding to the abutting section.

With such a developing device, the supporting section bends in a continuous manner from the position corresponding to the fulcrum of flexure to the position corresponding to the abutting section, and it becomes easy to adjust the pressing force from the charging member to the developer bearing body.

Further, in this developing device, the supporting section may be held between the supporting member and the sealing member at the fulcrum of flexure.

Further, in this developing device, the supporting section may be fixed to the supporting member through welding.

With such a developing device, it is possible to minimize the space required for the supporting member to support the supporting section, and also, the supporting member can support the supporting section stably.

It is also possible to achieve a developing device comprising: a developer container for containing developer; a developer bearing body for bearing the developer; a charging member for charging the developer bore by the developer bearing body by abutting against the developer bearing body; a supporting member for supporting the charging member; and a sealing member that is for preventing the developer from spilling from the developer container and that is provided in a state in which the side of one end thereof is compressed by the developer container and the charging member and the side of the other end thereof is compressed by the developer container and the supporting member, wherein, a degree of compression of the sealing member on the side of the other end is smaller than a degree of compression of the sealing member on the side of one end; at a position corresponding to the side of the other end of the sealing member, the rigidity of the supporting member is smaller than the rigidity of the developer container; the supporting member is fixed to the developing device at both ends of the supporting member in its longitudinal direction; the charging member includes an elastic section and a supporting section that supports the elastic section at the side of one end thereof and that has a fulcrum of flexure on the side of the other end thereof; the supporting member supports the supporting section at the side of the other end; the supporting section bends, with the fulcrum of flexure acting as a fulcrum, to make the elastic section abut against the developer bearing body at an abutting section and to charge the developer bore by the developer bearing body; the supporting section is fixed to the supporting member at a predetermined fixing point; the fixing point serves as the fulcrum of flexure; the sealing member is provided, on a side of the charging member opposite from the side of the developer bearing body, extending at least from a position corresponding to the fulcrum of flexure to a position corresponding to the abutting section; the supporting section is held between the supporting member and the sealing member at the fulcrum of flexure; and the supporting section is fixed to the supporting member through welding.

It is also possible to achieve an image forming apparatus comprising a developing device that includes: a developer container for containing developer; a developer bearing body for bearing the developer; a charging member for charging the developer bore by the developer bearing body by abutting against the developer bearing body; a supporting member for supporting the charging member; and a sealing member that is for preventing the developer from spilling from the developer container and that is provided in a state in which the side of one end thereof is compressed by the developer container and the charging member and the side of the other end thereof is compressed by the developer container and the supporting member, wherein a degree of compression of the sealing member on the side of the other end is smaller than a degree of compression of the sealing member on the side of one end.

It is also possible to achieve an image forming system comprising: a computer; and an image forming apparatus that is connectable to the computer and that has a developing device including: a developer container for containing developer; a developer bearing body for bearing the developer; a charging member for charging the developer bore by the developer bearing body by abutting against the developer bearing body; a supporting member for supporting the charging member; and a sealing member that is for preventing the developer from spilling from the developer container and that is provided in a state in which the side of one end thereof is compressed by the developer container and the charging member and the side of the other end thereof is compressed by the developer container and the supporting member, wherein a degree of compression of the sealing member on the side of the other end is smaller than a degree of compression of the sealing member on the side of one end.

(2) Another aspect of the present invention is a sealing member for preventing developer from spilling, comprising a foam obtained by foaming a mixture including at least rubber and a foaming agent.

In such a sealing member, the cells (air pockets) in the foam are small and the walls between cells are thin. Thus, the cells can easily gather together when the sealing member is compressed, and therefore, it becomes possible to prevent the developer from spilling from the sealing member.

Further, in this sealing member, the rubber may be ethylene-propylene-diene rubber.

Suitable cells can be formed with a foam using ethylene-propylene-diene rubber as the rubber, and therefore, it is possible to prevent the developer from spilling from the sealing member even preferably.

Further, in this sealing member, the foam may include both closed cells and open cells.

When a sealing member made of a foam including only closed cells is used in situations where the rigidity of members that hold the sealing member is small, there is a possibility that compression of the sealing member is insufficient and the sealing ability of the sealing member is impaired. On the other hand, with a sealing member made of a foam including both closed cells and open cells, the compression force necessary for compressing the sealing member for a predetermined amount can be made smaller than that necessary for compressing a sealing member made of a foam including only closed cells. Therefore, it is possible to solve the problem of the compression of the sealing member being insufficient, and it becomes possible to prevent the sealing ability of the sealing member from being impaired.

Further, a developing device comprises: a developer bearing body for bearing developer; an abutting member that abuts against the developer bearing body; an opposing member that is arranged in opposition to the abutting member on one side of the abutting member opposite from the side of the developer bearing body; and a sealing member for preventing the developer from spilling from between the abutting member and the opposing member, the sealing member being made of a foam obtained by foaming a mixture including at least rubber and a foaming agent.

In such a sealing member, the cells in the foam are small and the walls between cells are thin. Thus, the cells can easily gather together when the sealing member is compressed, and therefore, it becomes possible to prevent the developer from spilling from the sealing member.

Further, in this developing device, the rubber may be ethylene-propylene-diene rubber.

Suitable cells can be formed with a foam using ethylene-propylene-diene rubber as the rubber, and therefore, it is possible to prevent the developer from spilling from the sealing member even preferably.

Further, in this developing device, the foam may include both closed cells and open cells.

When a sealing member made of a foam including only closed cells is used in situations where the rigidity of members that hold the sealing member is small, there is a possibility that compression of the sealing member is insufficient and the sealing ability of the sealing member is impaired. On the other hand, with a sealing member made of a foam including both closed cells and open cells, the compression force necessary for compressing the sealing member for a predetermined amount can be made smaller than that necessary for compressing a sealing member made of a foam including only closed cells. Therefore, it is possible to solve the problem of the compression of the sealing member being insufficient, and it becomes possible to prevent the sealing ability of the sealing member from being impaired.

Further, in this developing device, the abutting member may be a charging member for charging the developer bore by the developer bearing body; and the sealing member may be provided in a state compressed between the charging member and the opposing member.

In a developing device in which the abutting member serves as a charging member and the sealing member is provided in a state compressed between the charging member and the opposing member, a compression-repulsion force is applied from the sealing member, which is being compressed, to the charging member. Since the charging member is an element for charging the developer bore by the developer bearing body, problems such as deterioration of the developer may occur if the compression-repulsion force is too large. On the other hand, by using a sealing member made of a foam including both closed cells and open cells, it becomes possible to reduce the compression-repulsion force applied from the sealing member to the charging member, and thereby solve the problems such as deterioration of the developer.

Further, in this developing device, the charging member may include an abutting section that abuts against the developer bearing body and a supporting section for supporting the abutting section; and the sealing member may be provided in a state compressed between the supporting section and the opposing member.

In a developing device in which the sealing member is provided in a state compressed between the supporting section and the opposing member, a compression-repulsion force is applied from the sealing member to the supporting section, and the problem involving deterioration of the developer, which is charged by the abutting section, becomes more significant. Therefore, the effect of being able to reduce the compression-repulsion force from the sealing member to the charging member can be achieved more advantageously by using a sealing member made of a foam including both closed cells and open cells.

Further, in this developing device, an abutting position where the abutting section abuts against the developer bearing body may be below the position of a center of rotation of the developer bearing body.

In a developing device in which the abutting position where the abutting section abuts against the developer bearing body is below the position of a center of rotation of the developer bearing body, the charging member charges the developer bore on the developer bearing body through a so-called "downward restriction". In such a situation, the developer is likely to gather around the sealing member, and the possibility of the developer spilling from the sealing member becomes even higher when a pressure is applied to a portion of the gathered developer. Therefore, the effect of the present invention, that is, the effect of being able to prevent the developer from spilling from the sealing member, can be achieved more advantageously.

It is also possible to achieve a developing device comprising: a developer bearing body for bearing developer; an abutting member that abuts against the developer bearing body; an opposing member that is arranged in opposition to the abutting member on one side of the abutting member opposite from the side of the developer bearing body; and a sealing member for preventing the developer from spilling from between the abutting member and the opposing member, the sealing member being made of a foam obtained by foaming a mixture including at least rubber and a foaming agent, wherein the rubber is ethylene-propylene-diene rubber; the foam includes both closed cells and open cells; the abutting member is a charging member for charging the developer bore by the developer bearing body; the sealing member is provided in a state compressed between the charging member and the opposing member; the charging member includes an abutting section that abuts against the developer bearing body and a supporting section for supporting the abutting section; the sealing member is provided in a state compressed between the supporting section and the opposing member; and an abutting position where the abutting section abuts against the developer bearing body is below the position of a center of rotation of the developer bearing body.

Further, it is possible to achieve an image forming apparatus comprising: an image bearing body for bearing a latent image; and a developing device that includes: a developer bearing body for bearing developer; an abutting member that abuts against the developer bearing body; an opposing member that is arranged in opposition to the abutting member on one side of the abutting member opposite from the side of the developer bearing body; and a sealing member for preventing the developer from spilling from between the abutting member and the opposing member, the sealing member being made of a foam obtained by foaming a mixture including at least rubber and a foaming agent, the developing device being capable of developing the latent image bore by the image bearing body with the developer bore by the developer bearing body.

In such a sealing member, the cells in the foam are small and the walls between cells are thin. Thus, the cells can easily gather together when the sealing member is compressed, and therefore, it becomes possible to prevent the developer from spilling from the sealing member.

Further, it is possible to achieve an image forming system comprising: a computer; and an image forming apparatus that is connectable to the computer, and that has an image bearing body for bearing a latent image and a developing device including: a developer bearing body for bearing developer; an abutting member that abuts against the developer bearing body; an opposing member that is arranged in opposition to the abutting member on one side of the abutting member opposite from the side of the developer bearing body; and a sealing member for preventing the developer from spilling from between the abutting member and the opposing member, the sealing member being made of a foam obtained by foaming a mixture including at least rubber and a foaming agent, the developing device being capable of developing the latent image bore by the image bearing body with the developer bore by the developer bearing body.

In such a sealing member, the cells in the foam are small and the walls between cells are thin. Thus, the cells can easily gather together when the sealing member is compressed, and therefore, it becomes possible to prevent the developer from spilling from the sealing member.

Further, it is possible to achieve a method for manufacturing a sealing member that is made of a foam and that is for preventing developer from spilling, the method comprising the steps of: foaming a mixture including at least rubber and a foaming agent to manufacture, from the mixture, a foam that includes a multitude of closed cells; and breaking some of the closed cells, among the multitude of closed cells, to manufacture a foam including both closed cells and open cells from the foam including the multitude of closed cells.

With such a manufacturing method, it is possible to manufacture a sealing member that is capable of preventing the developer from spilling.

Further, in this sealing-member manufacturing method, the rubber may be ethylene-propylene-diene rubber.

With such a manufacturing method, it is possible to manufacture a sealing member that is capable of preventing the developer from spilling even advantageously.

FIRST EMBODIMENT

Overall Configuration Example of Image Forming Apparatus

Next, using FIG. 1, an outline of a laser beam printer 10 (referred to also as "printer 10" below), which is an example of an image forming apparatus, is described. FIG. 1 is a diagram showing main structural components constructing the printer 10. It should be noted that in FIG. 1, the vertical direction is shown by the arrow, and, for example, a paper supply tray 92 is arranged at a lower section of the printer 10, and a fusing unit 90 is arranged at an upper section of the printer 10.

As shown in FIG. 1, the printer 10 according to the present embodiment includes a charging unit 30, an exposing unit 40, a rotating body 50, a first transferring unit 60, an intermediate transferring body 70, and a cleaning unit 75, all of which being arranged in the direction of rotation of a photoconductor 20, which serves as an example of an image bearing body for bearing a latent image. The printer 10 further includes a second transfer ring unit 80, a fusing unit 90, a displaying unit 95 constructed of a liquid-crystal panel and serving as means for making notifications to the user etc., and a control unit 100 for controlling these units etc. and managing the operations as a printer.

The photoconductor 20 has a cylindrical conductive base and a photoconductive layer formed on the outer peripheral surface of the conductive base, and it is rotatable about its central axis. In the present embodiment, the photoconductor 20 rotates clockwise, as shown by the arrow in FIG. 1.

The charging unit 30 is a device for charging the photoconductor 20. The exposing unit 40 is a device for forming a latent image on the charged photoconductor 20 by radiating a laser beam thereon. The exposing unit 40 has, for example, a semiconductor laser, a polygon mirror, and an F-θ lens, and radiates a modulated laser beam onto the charged photoconductor 20 according to image signals having been input from a not-shown host computer such as a personal computer or a word processor.

The rotating body 50 is a device for developing the latent image formed on the photoconductor 20 using black (K) toner contained in a black developing unit 51, magenta (M) toner contained in a magenta developing unit 52, cyan (C) toner contained in a cyan developing unit 53, and yellow (Y) toner contained in a yellow developing unit 54. The toner serves as an example of developer.

In the present embodiment, the rotating body 50 rotates to allow the positions of the four developing units 51, 52, 53, and 54, which serve as an example of developing devices, to be moved. More specifically, the rotating body 50 holds the four developing units 51, 52, 53, and 54 with four attach/detach sections 50*a*, 50*b*, 50*c*, and 50*d*, respectively, and the four developing units 51, 52, 53, and 54 can be rotated about a rotating shaft 50*e* while maintaining their relative positions. A different one of the developing units is made to selectively oppose the photoconductor 20 each time the photoconductor 20 makes one revolution, thereby successively developing the latent image formed on the photoconductor 20 using the toner contained in each of the developing units 51, 52, 53, and 54. It should be noted that details on the developing units are described further below.

The first transferring unit 60 is a device for transferring, onto the intermediate transferring body 70, a single-color toner image formed on the photoconductor 20. When toner images of four colors are successively transferred in a superposed manner, a full-color toner image is formed on the intermediate transferring body 70. The intermediate transfer ring body 70 is an endless belt that is driven to rotate at substantially the same circumferential speed as the photoconductor 20. The second transferring unit 80 is a device for transferring the single-color toner image, or the full-color toner image, formed on the intermediate transferring body 70 onto a recording medium such as paper, film, and cloth.

The fusing unit 90 is a device for fusing the single-color toner image or the full-color toner image, which has been transferred to the recording medium, onto the recording medium such as paper to make it into a permanent image.

The cleaning unit 75 is a device that is provided between the first transferring unit 60 and the charging unit 30, that has a rubber cleaning blade 76 made to abut against the surface of the photoconductor 20, and that is for removing the toner remaining on the photoconductor 20 by scraping it of f with the cleaning blade 76 after the toner image has been transferred onto the intermediate transferring body 70 by the first transferring unit 60.

Figure 2:
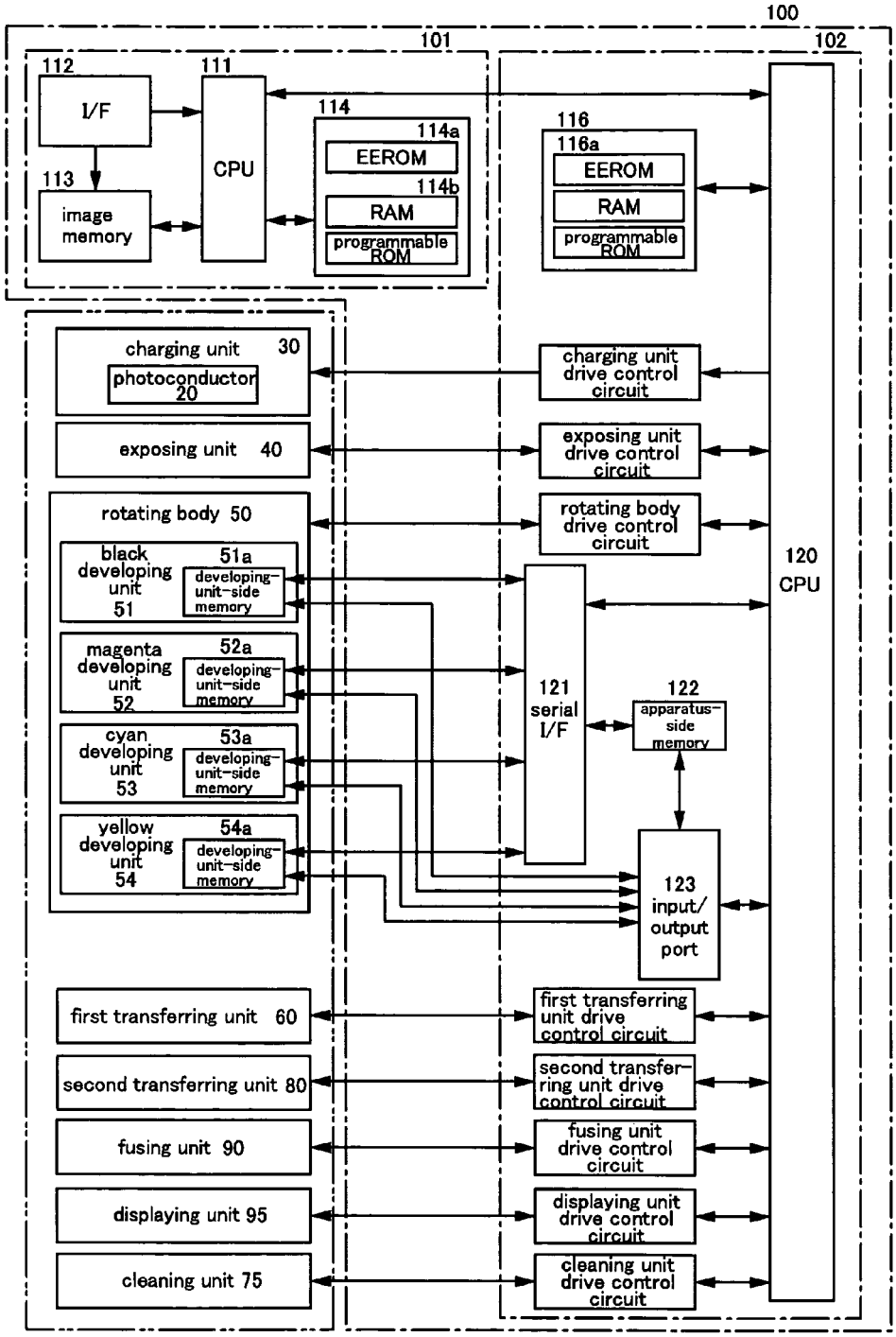
FIG. 2 is a block diagram showing a control unit 100 of the printer 10.

The control unit 100 includes a main controller 101 and a unit controller 102 as shown in FIG. 2. Image signals are input to the main controller 101, and according to instructions based on these image signals, the unit controller 102 controls each of the above-mentioned units etc. to form an image.

Next, operations of the printer 10 structured as above are described, referring also to other structural components.

When image signals are input from the not-shown host computer to the main controller 101 of the printer 10 through an interface (I/F) 112, then the photoconductor 20, a developing roller, which serves as an example of a developer bearing body that is provided in each developing unit, and the intermediate transferring body 70 rotate under the control of the unit controller 102 according to the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information for the first color, for example, yellow Y, is formed in that area by the exposing unit 40. The rotating body 50 positions the yellow developing unit 54, which contains yellow (Y) toner, at the developing position opposing the photoconductor 20.

With the rotation of the photoconductor 20, the latent image formed on the photoconductor 20 reaches the developing position, and is developed with the yellow toner by the yellow developing unit 54. Thus, a yellow toner image is formed on the photoconductor 20.

With the rotation of the photoconductor 20, the yellow toner image formed on the photoconductor 20 reaches a first transferring position, and is transferred onto the intermediate transferring body 70 by the first transferring unit 60. At this time, a first transferring voltage, which is in an opposite polarity to the polarity to which the toner is charged, is applied to the first transferring unit 60. It should be noted that, during this process, the second transferring unit 80 is kept separated from the intermediate transferring body 70.

By repeating the above-mentioned processes for the second, the third, and the fourth colors, toner images in four colors corresponding to the respective image signals are transferred to the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a recording medium by the second transferring unit 80. It should be noted that the recording medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the recording medium is heated and pressurized by the fusing unit 90 and fused to the recording medium.

On the other hand, after the photoconductor 20 passes the first transferring position, the toner adhering to the surface of the photoconductor 20 is scraped off by the cleaning blade 76 that is supported on the cleaning unit 75, and the photoconductor 20 is prepared for charging for the next latent image to be formed. The scraped-off toner is collected into a remaining-toner collector of the cleaning unit 75.

Configuration of Control Unit

Next, with reference to FIG. 2, the configuration of the control unit 100 will be described. FIG. 2 is a block diagram showing the control unit 100 of the printer 10. The control unit 100 includes a main controller 101 and a unit controller 102.

The main controller 101 includes a CPU 111, an interface 112 for establishing connection with the not-shown computer, an image memory 113 for storing image signals that have been input from the computer, and a main-controller-side memory 114 that is made up of, for example, an electrically rewritable EEPROM 114*a*, a RAM 114*b*, and a programmable ROM in which various programs for control are written.

The CPU 111 of the main controller 101 manages control of writing and reading of image data, which has been input via the interface, to and from the image memory 113, and also manages overall control of the apparatus in synchronism with the CPU 120 of the unit controller 102 according to control signals that have been input from the computer.

The unit controller 102 includes, for example, a CPU 120, a unit-controller-side memory 116 that is made up of, for example, an electrically rewritable EEPROM 116*a*, a RAM, and a programmable ROM in which various programs for control are written, and various drive control circuits for driving and controlling the units in the apparatus body (i.e., the charging unit 30, the exposing unit 40, the first transferring unit 60, the cleaning unit 75, the second transferring unit 80, the fusing unit 90, and the displaying unit 95) and the rotating body 50.

The CPU 120 of the unit controller 102 is electrically connected to each of the drive control circuits and controls the drive control circuits according to control signals from the CPU 111 of the main controller 101. More specifically, the CPU 120 controls each of the units and the rotating body 50 according to signals received from the main controller 101 while detecting the state of each of the units and the rotating body 50 by receiving signals from sensors, for example, provided in each unit.

Further, the CPU 120 of the unit controller 102 is connected, via a serial interface (I/F) 121, to a non-volatile storage element 122 (which is referred to below as "apparatus-side memory") which is, for example, a serial EEPROM. Data necessary for controlling the apparatus are stored in the apparatus-side memory 122. The CPU 120 is not only connected to the apparatus-side memory 122, but is also connected to the developing-unit-side memories 51*a*, 52*a*, 53*a*, and 54*a*, which are provided on the respective developing units 51, 52, 53, and 54, via the serial interface 121. Therefore, data can be exchanged between-the apparatus-side memory 122 and the developing-unit-side memories 51*a*, 52*a*, 53*a*, and 54*a*, and also, it is possible to input chip-select signals CS to the developing-unit-side memories 51*a*, 52*a*, 53*a*, and 54*a* via an input/output port 123.

Configuration Example of Developing Unit

Figure 3:
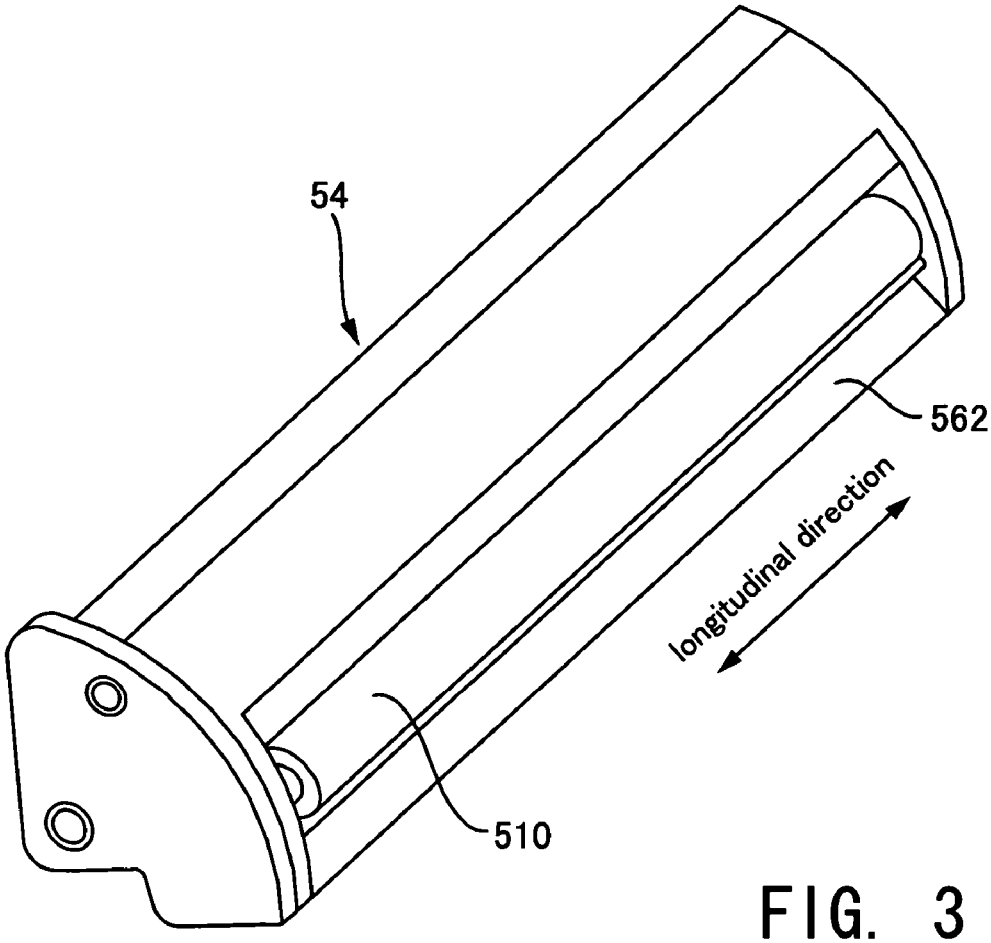
FIG. 3 is a conceptual diagram of a developing unit.
Figure 4:
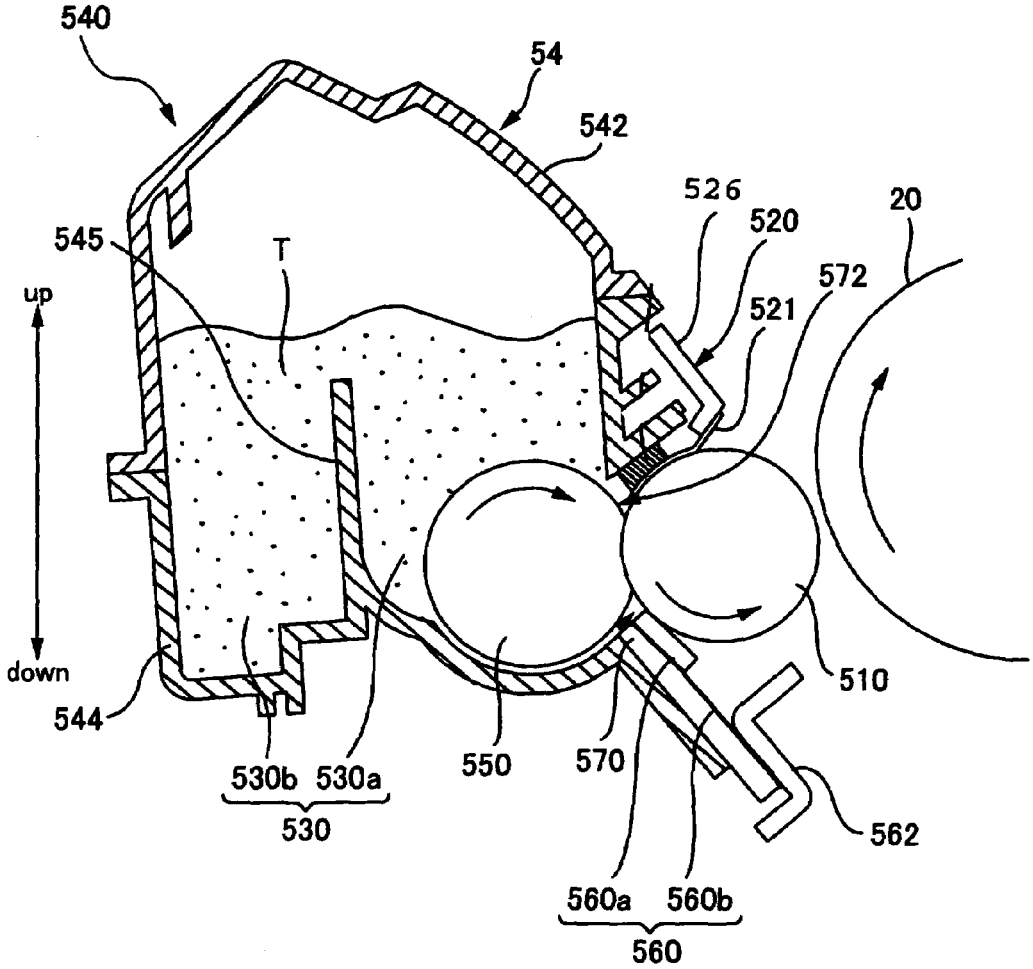
FIG. 4 is a section view showing main structural components of the developing unit.

Next, using FIG. 3 and FIG. 4, an example of a configuration of a developing unit, which serves as an example of a developing device, will be described. FIG. 3 is a conceptual diagram of a developing unit. FIG. 4 is a section view showing main structural components of the developing unit. Note that the section view shown in FIG. 4 is a cross section of the developing unit bisected by a plane perpendicular to the longitudinal direction shown in FIG. 3. Further, in FIG. 4, the arrow indicates the vertical direction as in FIG. 1, and, for example, the central axis of the developing roller 510 is located below the central axis of the photoconductor 20. Further, in FIG. 4, the yellow developing unit 54 is shown to be in a state in which it is positioned at the developing position opposing the photoconductor 20.

To the rotating body 50, it is possible to attach: the black developing unit 51 containing black (K) toner; the magenta developing unit 52 containing magenta (M) toner; the cyan developing unit 53 containing cyan (C) toner; and the yellow developing unit 54 containing yellow (Y) toner. Since the configuration of the developing units is the same, explanation will be made only about the yellow developing unit 54 below.

The yellow developing unit 54 has the developing roller 510 which serves as an example of a developer bearing body, a toner containing section 530, a housing 540 which serves as an example of a developer container, a toner supplying roller 550, a restriction blade 560 which serves as an example of a charging member, and a sealing unit 520 which is provided with several seals.

The developing roller 510 bears toner T and delivers it to the developing position opposing the photoconductor 20. The developing roller 510 is made of metal and, for example, it is manufactured from aluminum alloy such as aluminum alloy 5056 or aluminum alloy 6063, or iron alloy such as STKM, and the roller 510 is plated with, for example, nickel plating or chromium plating, as necessary. Further, as shown in FIG. 3, the developing roller 510 is supported at both ends in its longitudinal direction and is rotatable about its central axis. As shown in FIG. 4, the developing roller 510 rotates in the opposite direction (counterclockwise in FIG. 4) to the rotating direction of the photoconductor 20 (clockwise in FIG. 4). The central axis of the roller 510 is located below the central axis of the photoconductor 20. Further, as shown in FIG. 4, in the state where the yellow developing unit 54 opposes the photoconductor 20, there is a gap between the developing roller 510 and the photo conductor 20. That is, the yellow developing unit 54 develops the latent image formed on the photoconductor 20 in a non-contacting state. It should be noted that an alternating field is generated between the developing roller 510 and the photoconductor 20 upon development of the latent image formed on the photoconductor 20.

The sealing unit 520 includes: an upper seal 521 for preventing toner from spilling out from between the developing roller 510 and a section of the housing 540 which defines the upper edge of the opening 572; the restriction blade 560 that functions also as to prevent toner from spilling out from between the developing roller 510 and a section of the housing 540 which defines the lower edge of the opening 572; and a sealing frame 526 (see FIG. 7) to which the upper seal 521 and the restriction blade 560 are attached and which is for fixing them integrally to the housing 540.

The housing 540 is manufactured by welding together a plurality of integrally-molded housing sections, that is, an upper housing section 542 and a lower housing section 544. The inside of the housing 540 is divided into two toner containing sections 530, namely, the first toner containing section 530*a* and the second toner containing section 530*b*, by a partitioning wall 545 that protrudes inwards (in the up/down direction of FIG. 4) from the inner wall and that is for partitioning the toner T. It should be noted that the opening 572 is located at the lower section of the housing 540, and the developing roller 510 is arranged with respect to the opening 572 such that a portion of the roller 510 is exposed from the opening.

The toner containing sections 530 may be provided with a stirring member for stirring the toner T. In the present embodiment, however, no stirring member is provided in the toner containing sections 530 because each of the developing units (i.e., the black developing unit 51, the magenta developing unit 52, the cyan developing unit 53, and the yellow developing unit 54) is rotated with the rotation of the rotating body 50 and the toner T in each developing unit is thereby stirred.

The toner supplying roller 550 is provided in the first toner containing section 530*a* described above and supplies the toner T contained in the first toner containing section 530*a* to the developing roller 510. The toner supplying roller 550 is made of, for example, polyurethane foam, and is made to abut against the developing roller 510 in an elastically deformed state. The toner supplying roller 550 is arranged at a lower section of the toner containing section 530. The toner T contained in the toner containing sections 530 is supplied to the developing roller 510 by the toner supplying roller 550 at the lower section of the toner containing section 530.

The toner supplying roller 550 is rotatable about its central axis. The central axis of the toner supplying roller 550 is situated below the central axis of rotation of the developing roller 510. Further, the toner supplying roller 550 rotates in the opposite direction (clockwise in FIG. 4) to the rotating direction of the developing roller 510 (counter-clockwise in FIG. 4). It should be noted that the toner supplying roller 550 has the function of supplying the toner T contained in the toner containing section 530 to the developing roller 510 as well as the function of stripping off, from the developing roller 510, the toner T remaining on the developing roller 510 after development.

The restriction blade 560 electrically charges the toner T bore by the developing roller 510 and also restricts the thickness of the layer of the toner T bore by the developing roller 510. Details on the restriction blade 560 and its peripheral structure are described further below.

In the yellow developing unit 54 structured as above, the toner supplying roller 550 supplies the toner T contained in the toner containing section 530 to the developing roller 510. With the rotation of the developing roller 510, the toner T, which has been supplied to the developing roller 510, reaches the abutting position of the restriction blade 560; then, as the toner T passes the abutting position, the toner is electrically charged and its layer thickness is restricted. With further rotation of the developing roller 510, the toner T on the developing roller 510, whose layer thickness has been restricted, reaches the developing position opposing the photoconductor 20; then, under the alternating field, the toner T is used at the developing position for developing the latent image formed on the photoconductor 20. With further rotation of the developing roller 510, the toner T on the developing roller 510, which has passed the developing position, passes the sealing unit 520 and is collected into the developing unit without being scraped off by the sealing unit 520. Then, the toner T that still remains on the developing roller 510 can be stripped off by the toner supplying roller 550.

Structure of Restriction Blade and its Periphery

Figure 5:
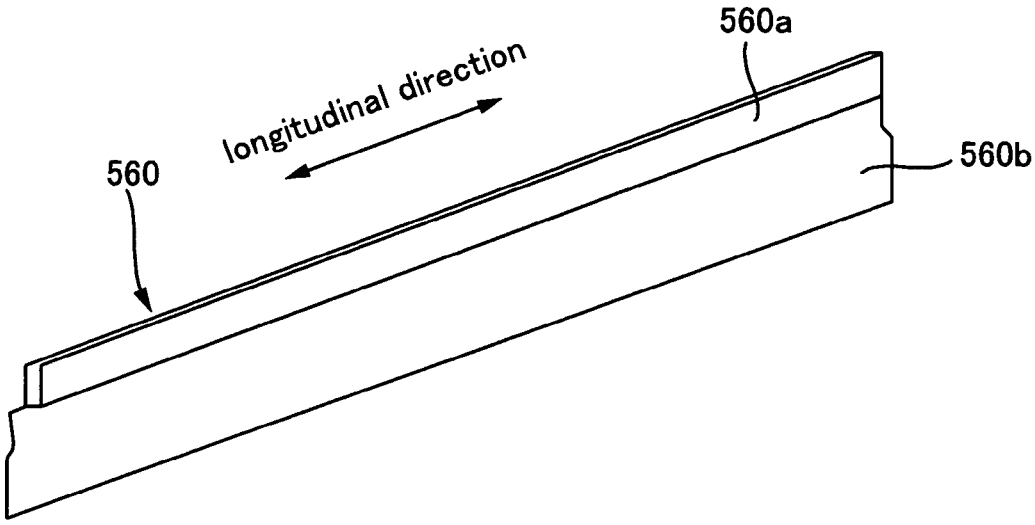
FIG. 5 is a perspective view of a restriction blade 560.
Figure 6:
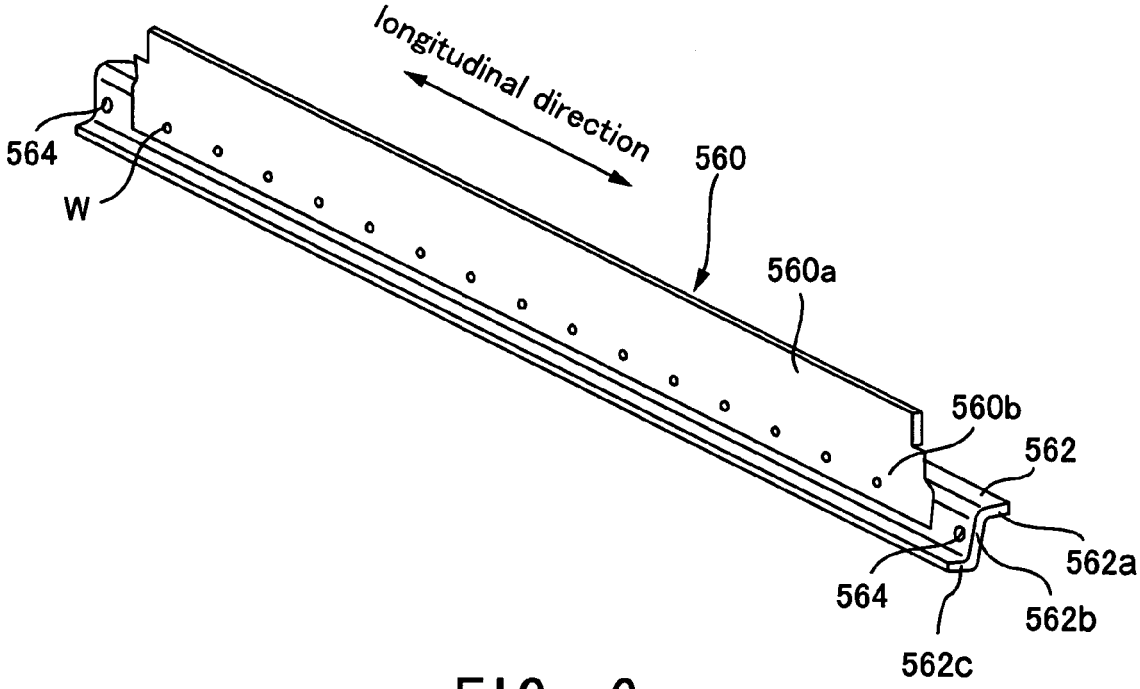
FIG. 6 is a diagram showing a state in which the restriction blade 560 is fixed to a blade-supporting metal plate 562, with the backside of the abutting surface of a rubber section 560*a* against a developing roller 510 facing toward the front.
Figure 7:
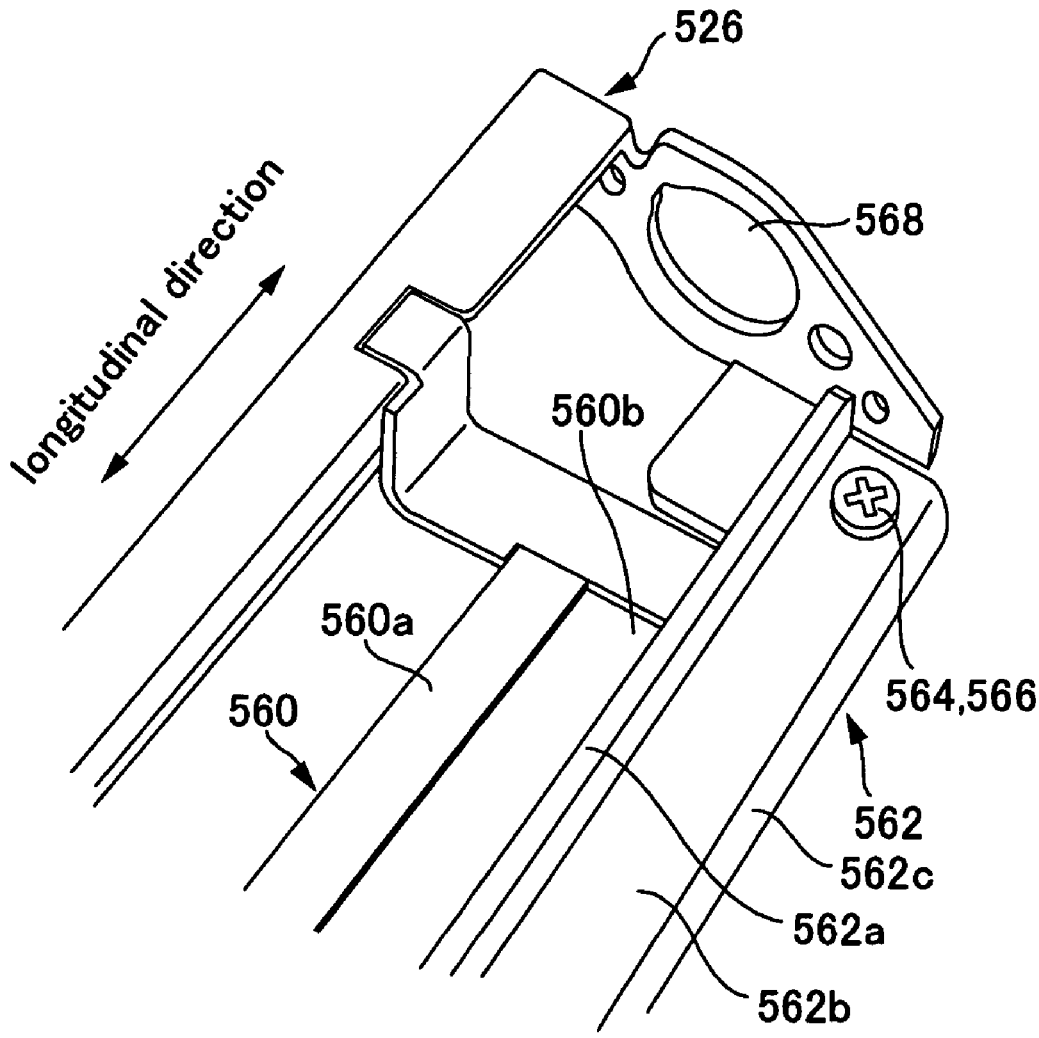
FIG. 7 is a perspective view showing the restriction blade 560 attached to a frame 526 by means of the blade-supporting metal plate 562.

Next, a structure of the restriction blade and its periphery is described with reference to the drawings. FIG. 5 is a perspective view of the restriction blade 560. FIG. 6 is a diagram showing a state in which the restriction blade 560 is fixed to a blade-supporting metal plate 562, with the backside of the abutting surface of a rubber section 560*a* against the developing roller 510 facing toward the front. FIG. 7 is a perspective view showing the restriction blade 560 attached to the sealing frame 526 by means of the blade-supporting metal plate 562.

As described above, the restriction blade 560, which serves as an example of a charging member, electrically charges the toner T by giving a charge to the toner T bore on the developing roller 510. The restriction blade 560 also restricts the thickness of the layer of the toner T bore on the developing roller 510.

As shown in FIG. 5, this restriction blade 560 has a rubber section 560*a*, which serves as an example of an elastic section, and a rubber-supporting section 560*b*, which serves as an example of a supporting section. The rubber section 560*a* is made of an elastic body such as silicone rubber or urethane rubber. The rubber-supporting section 560*b* is a thin plate having a springy characteristic whose thickness is 1 mm or less and being made of, for example, phosphor bronze or stainless steel.

As shown in FIG. 5, the rubber section 560*a* is supported on the side of one end of the rubber-supporting section 560*b*. As shown in FIG. 4, the abutting section of the rubber section 560*a* abuts against the surface of the developing roller 510 to achieve the above-mentioned functions with respect to the toner T bore on the developing roller 510.

As shown in FIG. 6, the rubber-supporting section 560*b* is fixed to the blade-supporting metal plate 562, which serves as a second supporting member for supporting the restriction blade 560, at predetermined fixing points (the points shown by "W" in FIG. 6) on the side of the other end of the rubber-supporting section 560*b*. These predetermined fixing points W serve as the fulcrum of flexure described below. The blade-supporting metal plate 562 is, for example, a steel plate provided with a zinc plating layer.

As shown in FIG. 6, the blade-supporting metal plate 562 has a first bent section 562*a*, a supporting section 562*b*, and a second bent section 562*c*. These sections 562*a*, 562*b*, and 562*c* are formed by bending a rectangular member, which has a thickness of 1.8 mm or more, along its longitudinal direction. The directions toward which the first bent section 562*a* and the second bent section 562*c* are bent are in opposite directions, and as shown in FIG. 4, the sectional profile of the member has a so-called "Z" shape. It should be noted that in the present embodiment, of the two bent sections 562*a* and 562*c*, the one closer to the rubber section 560*a* is regarded as the first bent section 562*a*.

As shown in FIG. 4 and FIG. 6, the supporting section 562*b* supports the restriction blade 560 by the rubber-supporting section 560*b* being fixed to the supporting section 562*b*. This fixing is achieved by carrying out spot welding using laser welding.

Further, as shown in FIG. 6, the blade-supporting metal plate 562 has screw holes 564 in both ends, in the longitudinal direction, of the supporting section 562*b* for fixing the blade-supporting metal plate 562 to the developing device. As shown in FIG. 7, the blade-supporting metal plate 562 is fixed to the sealing frame 526 with screws 566 at both ends, in the longitudinal direction, of the supporting section 562*b*. Although FIG. 7 shows only one end, in the longitudinal direction, of the blade-supporting metal plate 562, the other end is configured in the same way.

It should be noted that although it is not shown in FIG. 7, the developing roller 510 is supported by the developing-roller supporting holes 568 provided in both ends, in the longitudinal direction, of the sealing frame 526. That is, in FIG. 7, the developing roller 510 would be positioned above the restriction blade 560. Thus, the developing roller 510 would be placed close to the first bent section 562*a*, and therefore, the first bent section 562*a* can function as to prevent the toner T from spilling out from, for example, the abutting section between the developing roller 510 and the restriction blade 560. On the other hand, as shown in FIG. 7, the second bent section 562*c* is placed in abutment against the outer edge of the sealing frame 526, and therefore, it can function as to suitably position the restriction blade 560.

It should be noted that the rigidity of the blade-supporting metal plate 562 is set to be smaller than the rigidity of the housing 540. The reason to this is that, although a high rigidity is demanded of the housing 540 because it structures the overall frame of the developing unit, the blade-supporting metal plate 562 is not required to have such a rigidity.

Further, as shown in FIG. 4, a blade-backing member 570 (serving as an example of a sealing member) made of, for example, Moltoprene is provided on one side of the restriction blade 560 opposite from the side of the developing roller 510. Details on the blade-backing member 570 are described below with reference to the drawings.

Figure 8:
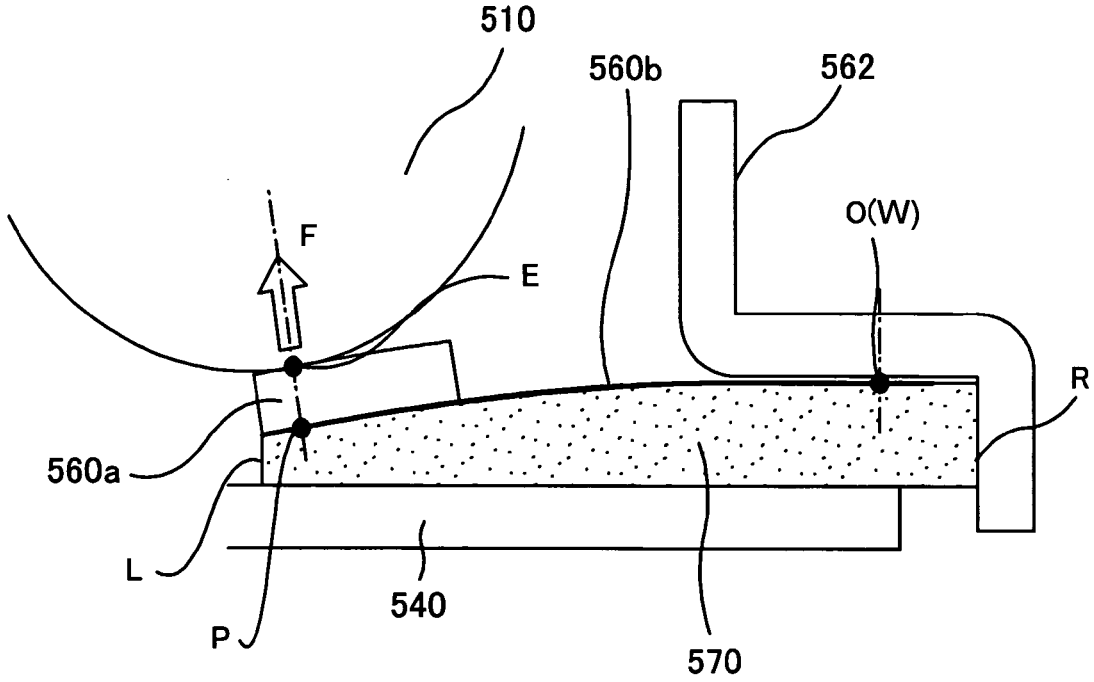
FIG. 8 is a diagram showing a configuration of the periphery of a blade-backing member 570.

FIG. 8 is a diagram showing a configuration of the periphery of the blade-backing member 570. The arrow shown by "F" in FIG. 8 indicates the pressing force that is applied from the restriction blade 560 to the developing roller 510. The section shown by "E" in FIG. 8 indicates the abutting section at which the rubber section 560*a* abuts against the developing roller 510. The section shown by "O" in FIG. 8 indicates the position corresponding to the fulcrum of flexure of the rubber-supporting section 560*b*. The section shown by "P" in FIG. 8 indicates the position corresponding to the abutting section "E" on the rubber-supporting section 560*b*. The section shown by "L" in FIG. 8 indicates one end of the blade-backing member 570. The section shown by "R" in FIG. 8 indicates the other end of the blade-backing member 570.

Figure 9:
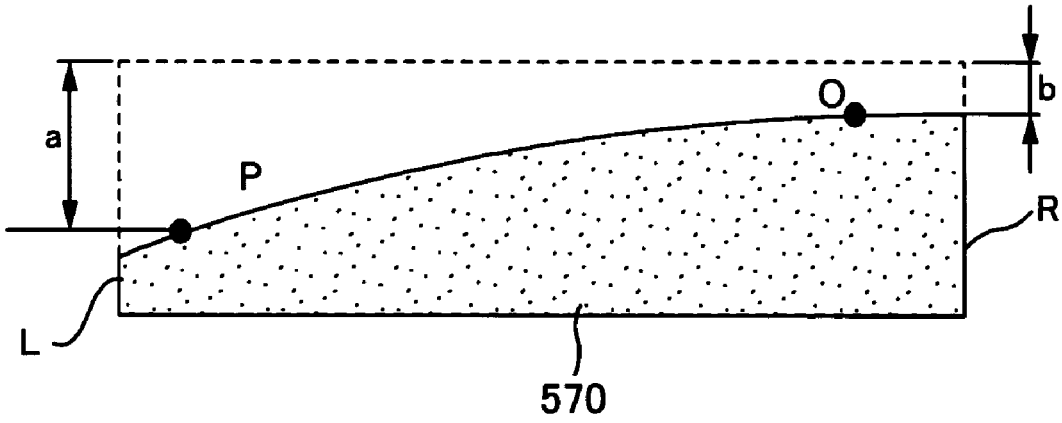
FIG. 9 is a diagram showing the shape of the blade-backing member 570.

FIG. 9 is a diagram showing the shape of the blade-backing member 570 corresponding to the direction shown in FIG. 8. In FIG. 9, the rectangular area surrounded by the dotted lines and the straight lines indicates the shape of the blade-backing member 570 before it is compressed. On the other hand, the area surrounded by the solid lines indicates the shape of the blade-backing member 570 after it is compressed when the restriction blade 560 abuts against the developing roller 510 as shown in FIG. 8.

The blade-backing member 570 is provided, on one side of the rubber-supporting section 560*b* opposite from the side of the developing roller 510, extending at least from the position "O" corresponding to the fulcrum of flexure to the position "P" corresponding to the abutting section. Further, the blade-backing member 570 is provided such that one end "L" of the blade-backing member 570 is positioned on a side opposite from the position "O", which corresponds to the fulcrum of flexure, with respect to the position "P" corresponding to the abutting section, and that the other end "R" of the blade-backing member 570 is positioned on a side opposite from the position "P", which corresponds to the abutting section, with respect to the position "O" corresponding to the fulcrum of flexure. Further, as shown in FIG. 8, the rubber-supporting section 560*b* is held between the blade-supporting metal plate 562 and the blade-backing member 570 at the fulcrum of flexure "W".

Further, the blade-backing member 570 is provided in a state in which the side of one end "L" is compressed by the housing 540 and the restriction blade 560, and the side of the other end "R" is compressed by the housing 540 and the blade-supporting metal plate 562. As shown in FIG. 9, on the side of the other end "R", the blade-backing member 570 is compressed by a length "b". On the other hand, on the side of the end "L", the blade-backing member 570 is compressed by a length "a". It should be noted that, as shown in FIG. 9, "a" and "b" are set such that a>b. Therefore, the degree of compression (which is referred to also as "compression rate" below) of the blade-backing member 570 on the side of the other end "R" thereof is smaller than the degree of compression of the blade-backing member 570 on the side of one end "L" thereof.

As described above, by providing the blade-backing member 570 on one side of the restriction blade 560 opposite from the side of the developing roller 510, the blade-backing member 570 prevents the toner from entering in between the rubber-supporting section 560*b* and the housing 540 to stabilize the elastic force of the rubber-supporting section 560*b*. Further, the blade-backing member 570 presses the rubber section 560*a* against the developing roller 510 by applying force to the rubber section 560*a* in the direction of the developing roller 510 from right behind the rubber section 560*a*. Therefore, the blade-backing member 570 serves as to cause the rubber section 560*a* to abut against the developing roller 510 more evenly. In this way, the restriction blade 560 applies an even pressing force F to the developing roller 510.

The end of the restricting blade 560 opposite to the end that is supported by the blade-supporting metal plates 562, i.e., the tip end, is not placed in contact with the developing roller 510; rather, a section at a predetermined distance from the tip end contacts, with some breadth, the developing roller 510. That is, the restriction blade 560 does not abut against the developing roller 510 at its edge, but abuts against the roller 510 near its central portion. Further, the restriction blade 560 is arranged such that its tip end faces towards the upstream side of the rotating direction of the developing roller 510, and thus, makes a so-called counter-abutment with respect to the roller 510. It should be noted that the abutting position at which the restriction blade 560 abuts against the developing roller 510 is below the central axis of the developing roller 510 and is also below the central axis of the toner supplying roller 550.

Pressing Force Applied from the Restriction Blade 560 to the Developing Roller 510

As described in the section of the "Description of the Related Art", when, for example, the sealing member is compressed evenly and sufficiently across the whole distance from the side of one end to the other in order to appropriately prevent developer from spilling from the developer container, the following problem may arise. Since the compression-repulsion force of the blade-backing member 570 causes a force to be applied to the blade-supporting metal plate 562 at the side of the other end (the end "R" in FIG. 8), this force may cause the blade-supporting metal plate 562 to bend. Bending of the blade-supporting metal plate 562 may cause the restriction blade 560 supported by the blade-supporting metal plate 562 to bend. Then, due to the bending of the restriction blade 560, the pressing force from the restriction blade 560 to the developing roller 510 may become uneven.

Figure 10:
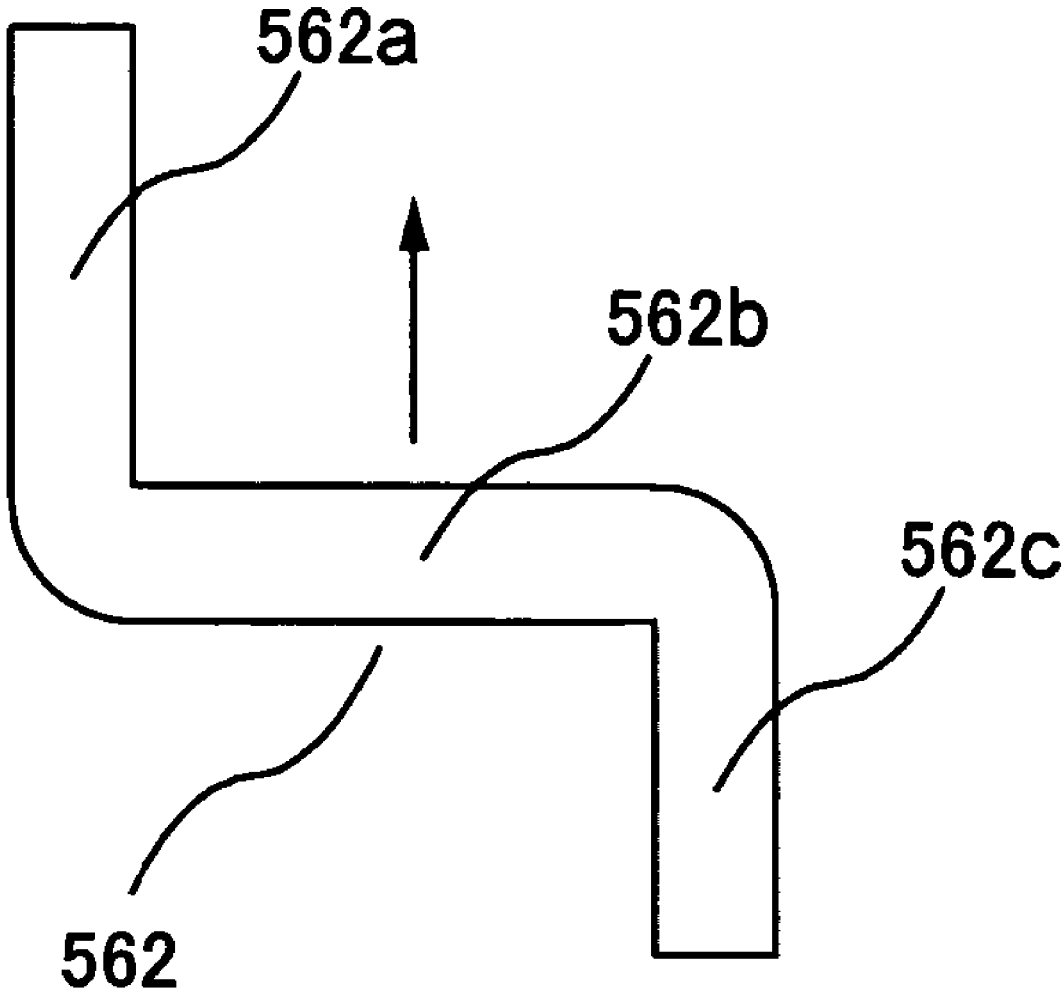
FIG. 10 is a schematic diagram showing a cross section of the blade-supporting metal plate 562 taken along a plane perpendicular to the longitudinal direction.
Figure 11:
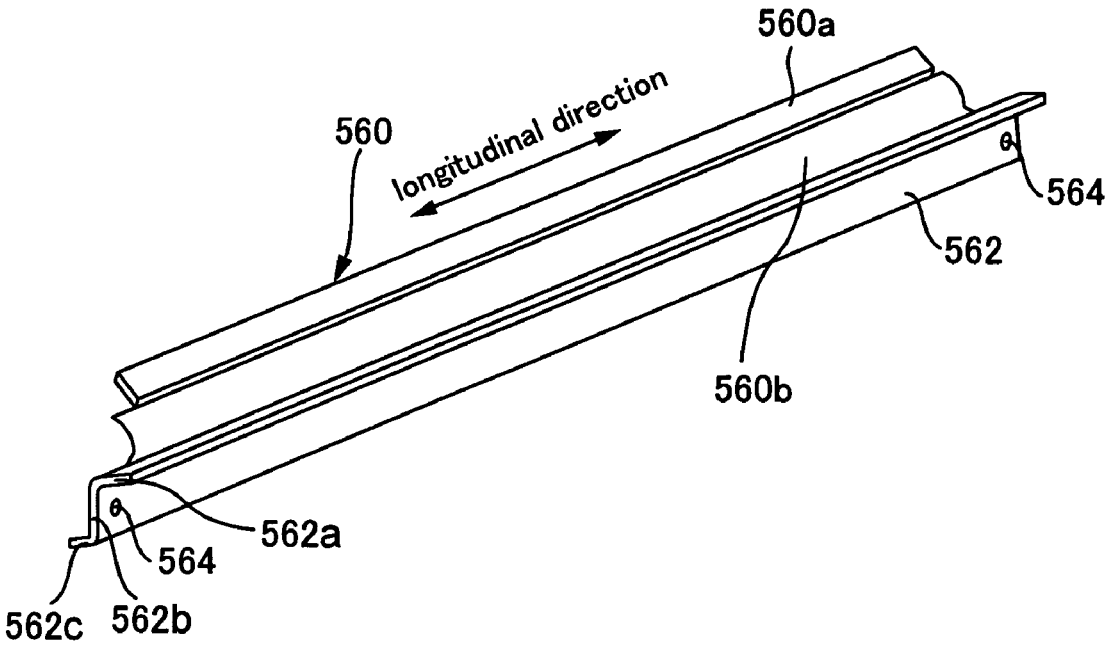
FIG. 11 is a diagram showing how the restriction blade 560 is bent when the restriction blade 560, which is fixed to the blade-supporting metal plate 562, abuts against the developing roller 510.

The situation above is described in further detail with reference to the drawings. FIG. 10 is a schematic diagram showing a cross section of the blade-supporting metal plate 562 taken along a plane perpendicular to the longitudinal direction. FIG. 11 is a diagram showing how the restriction blade 560 is bent when the restriction blade 560, which is fixed to the blade-supporting metal plate 562, abuts against the developing roller 510. It should be noted that FIG. 11 shows a state in which the restriction blade 560 has been bent, with the fulcrum of flexure "W" acting as the fulcrum.

The compression-repulsion force of the blade-backing member 570 becomes larger in accordance with the increase in the degree of compression of the blade-backing member 570. Therefore, for example, when the degree of compression of the blade-backing member 570 between the blade-supporting metal plate 562 and the housing 540 is large, a compression-repulsion force of the blade-backing member 570, which corresponds to the intensity of the degree of compression, is applied to the blade-supporting metal plate 562 in the direction of the arrow shown in FIG. 10.

As described above, the blade-supporting metal plate 562 is fixed to the sealing frame 526 at both ends, in the longitudinal direction, of the supporting section 562*b* with screws 564 (see FIG. 7). Therefore, when a compression-repulsion force from the blade-backing member 570 is applied thereto, the central section, in the longitudinal direction, of the blade-supporting metal plate 562 may bend in the direction of the arrow shown in FIG. 10.

Since the restriction blade 560 is supported by the blade-supporting metal plate 562, the restriction blade 560 may also bend due to the bending that has occurred in the central section, in the longitudinal direction, of the blade-supporting metal plate 562. More specifically, when the central section, in the longitudinal direction (see FIG. 11), of the blade-supporting metal plate 562 bends in the direction of the arrow shown in FIG. 10, the central section, in the longitudinal direction (see FIG. 11), of the restriction blade 560 will as well bend in the same direction. Therefore, the restriction blade 560 is not only subjected to bending that occurs when it abuts against the developing roller 510, in which case the fulcrum of flexure "W" acts as the fulcrum, but also, the restriction blade 560 is subjected to bending at its central section in the longitudinal direction thereof due to the compression-repulsion force of the blade-backing member 570. As a result, the pressing force from the restriction blade 560 to the developing roller 510 may become uneven.

In the printer 10 according to the present embodiment of the invention, by making the degree of compression of the blade-backing member 570 on the side of the end "R" (the other end) of the member 570 smaller than the degree of compression of the blade-backing member 570 on the side of the end "L" (the one end) of the member 570, the blade-backing member 570 is compressed on the side of the other end "R" thereof such that bending does not occur in the blade-supporting metal plate 562. In this way, it is possible to make the pressing force F from the restriction blade 560 to the developing roller 510 even.

Other Considerations

The present invention relates to a developing device (such as the developing units 51, 52, 53, and 54) comprising: a developer container (such as the housing 540) for containing developer (such as the toner T); a developer bearing body (such as the developing roller 510) for bearing the developer; a charging member (such as the restriction blade 560) for charging the developer bore by the developer bearing body by abutting against the developer bearing body; a supporting member (such as the blade-supporting metal plate 562) for supporting the charging member; and a sealing member (such as the blade-backing member 570) that is for preventing the developer from spilling from the developer container and that is provided in a state in which the side of one end thereof (for example, the section "L" shown in FIG. 8) is compressed by the developer container and the charging member and the side of the other end thereof (for example, the section "R" shown in FIG. 8) is compressed by the developer container and the supporting member.

In the foregoing embodiment, the rigidity of the blade-supporting metal plate 562 was smaller than the rigidity of the housing 540 at the position corresponding to the side of the other end "R" of the blade-backing member 570. This, however, is not a limitation.

For example, the rigidity of the blade-supporting metal plate 562 may be the same as the rigidity of the housing 540 at the position corresponding to the side of the other end "R" of the blade-backing member 570.

However, when the rigidity of the blade-supporting metal plate 562 is smaller than the rigidity of the housing 540 at the position corresponding to the side of the other end "R" of the blade-backing member 570, the bending caused by the compression-repulsion force of the blade-backing member 570 at the position corresponding to the side of the other end "R" of the blade-backing member 570 is likely to occur in the blade-supporting metal plate 562 rather than the housing 540, and thus, the pressing force F from the restriction blade 560 to the developing roller 510 may become uneven.

Therefore, the foregoing embodiment is more preferable in terms that the above-mentioned effect, that is, the effect of being able to make the pressing force F from the restriction blade 560 to the developing roller 510 even, is achieved more advantageously.

Further, in the foregoing embodiment, the blade-supporting metal plate 562 was fixed to the sealing frame 526 of each developing unit 51, 52, 53, and 54 at both ends of the blade-supporting metal plate 562 in its longitudinal direction (see FIG. 7). This, however, is not a limitation.

For example, the blade-supporting metal plate 562 may be fixed to the developing unit 51, 52, 53, or 54 at its central section in the longitudinal direction thereof.

However, when the blade-supporting metal plate 562 is fixed to the sealing frame 526 of each developing unit 51, 52, 53, and 54 at both ends of the blade-supporting metal plate 562 in its longitudinal direction, the bending caused by the compression-repulsion force of the blade-backing member 570 is likely to occur in the central section, in the longitudinal direction, of the blade-supporting metal plate 562, and thus, the pressing force F from the restriction blade 560 to the developing roller 510 may become uneven.

Therefore, the foregoing embodiment is more preferable in terms that the above-mentioned effect, that is, the effect of being able to make the pressing force F from the restriction blade 560 to the developing roller 510 even, is achieved more advantageously.

Further, in the foregoing embodiment, the restriction blade 560 included a rubber section 560*a* and a rubber-supporting section 560*b* that supports the rubber section 560*a* at the side of one end "L" thereof and that has a fulcrum of flexure (for example, the section "W" shown in FIG. 6) on the side of the other end "R" thereof; the blade-supporting metal plate 562 supported the rubber-supporting section 560*b* at the side of the other end "R"; and the rubber-supporting section 560*b* was bent, with the fulcrum of flexure "W" acting as a fulcrum, to make the rubber section 560*a* abut against the developing roller 510 at an abutting section "E" and to charge the toner T bore by the developing roller 510. This, however, is not a limitation.

For example, the restriction blade 560 does not have to be provided with a rubber-supporting section 560*b* that supports the rubber section 560*a* at the side of one end "L" thereof and that has a fulcrum of flexure "W" on the side of the other end "R" thereof.

However, in a developing unit that has a restriction blade 560 including a rubber section 560*a* and a rubber-supporting section 560*b* that supports the rubber section 560*a* at the side of one end "L" thereof and that has a fulcrum of flexure (for example, the section "W" shown in FIG. 6) on the side of the other end "R" thereof, the restriction blade 560 uses the bending of the rubber-supporting section 560*b* to apply the pressing force F against the developing roller 510.

Therefore, the foregoing embodiment is more preferable in terms that the above-mentioned effect, that is, the effect of being able to make the pressing force F from the restriction blade 560 to the developing roller 510 even, is achieved more advantageously.

Further, in the foregoing embodiment, the rubber-supporting section 560*b* was fixed to the blade-supporting metal plate 562 at a predetermined fixing point "W"; and the fixing point "W" served as the fulcrum of flexure. This, however, is not a limitation.

For example, the fixing point "W" does not have to serve as the fulcrum of flexure.

However, in a developing unit in which the fixing point "W" acts as the fulcrum of flexure, the restriction blade 560 uses the bending of the rubber-supporting section 560*b* to apply the pressing force F against the developing roller 510.

Therefore, the foregoing embodiment is more preferable in terms that the above-mentioned effect, that is, the effect of being able to make the pressing force F from the restriction blade 560 to the developing roller 510 even, is achieved more advantageously.

Further, in the foregoing embodiment, the blade-backing member 570 was provided, on one side of the restriction blade 560 opposite from the side of the developing roller 510, extending at least from the position "O" corresponding to the fulcrum of flexure to the position "P" corresponding to the abutting section (see FIG. 8). This, however, is not a limitation.

For example, the blade-backing member 570 may be provided, on one side of the restriction blade 560 opposite from the side of the developing roller 510, only between the position "O" corresponding to the fulcrum of flexure and the position "P" corresponding to the abutting section.

However, by providing the blade-backing member 570, on one side of the restriction blade 560 opposite from the side of the developing roller 510, extending at least from the position "O" corresponding to the fulcrum of flexure to the position "P" corresponding to the abutting section, the rubber-supporting section 560*b* bends in a continuous manner from the position "O" corresponding to the fulcrum of flexure to the position "P" corresponding to the abutting section, and it becomes easy to adjust the pressing force F from the restriction blade 560 to the developing roller 510.

Therefore, the foregoing embodiment is more preferable.

Further, in the foregoing embodiment, the rubber-supporting section 560*b* was held between the blade-supporting metal plate 562 and the blade-backing member 570 at the fulcrum of flexure "W" (see FIG. 8). This, however, is not a limitation.

For example, the rubber-supporting section 560*b* does not have to be held between the blade-supporting metal plate 562 and the blade-backing member 570 at the fulcrum of flexure.

Further, in the foregoing embodiment, the rubber-supporting section 560*b* was fixed to the blade-supporting metal plate 562 through spot welding (see FIG. 6). This, however, is not a limitation.

For example, the rubber-supporting section 560*b* may be fixed to the blade-supporting metal plate 562 with screws etc.

The foregoing embodiment, however, is more preferable in terms that, by fixing the rubber-supporting section 560*b* to the blade-supporting metal plate 562 through spot welding, it is possible to minimize the space required for the blade-supporting metal plate 562 to support the rubber-supporting section 560*b*, and also, the blade-supporting metal plate 562 can support the rubber-supporting section 560*b* stably.

SECOND EMBODIMENT

Overview of Image Forming Apparatus

Figure 12:
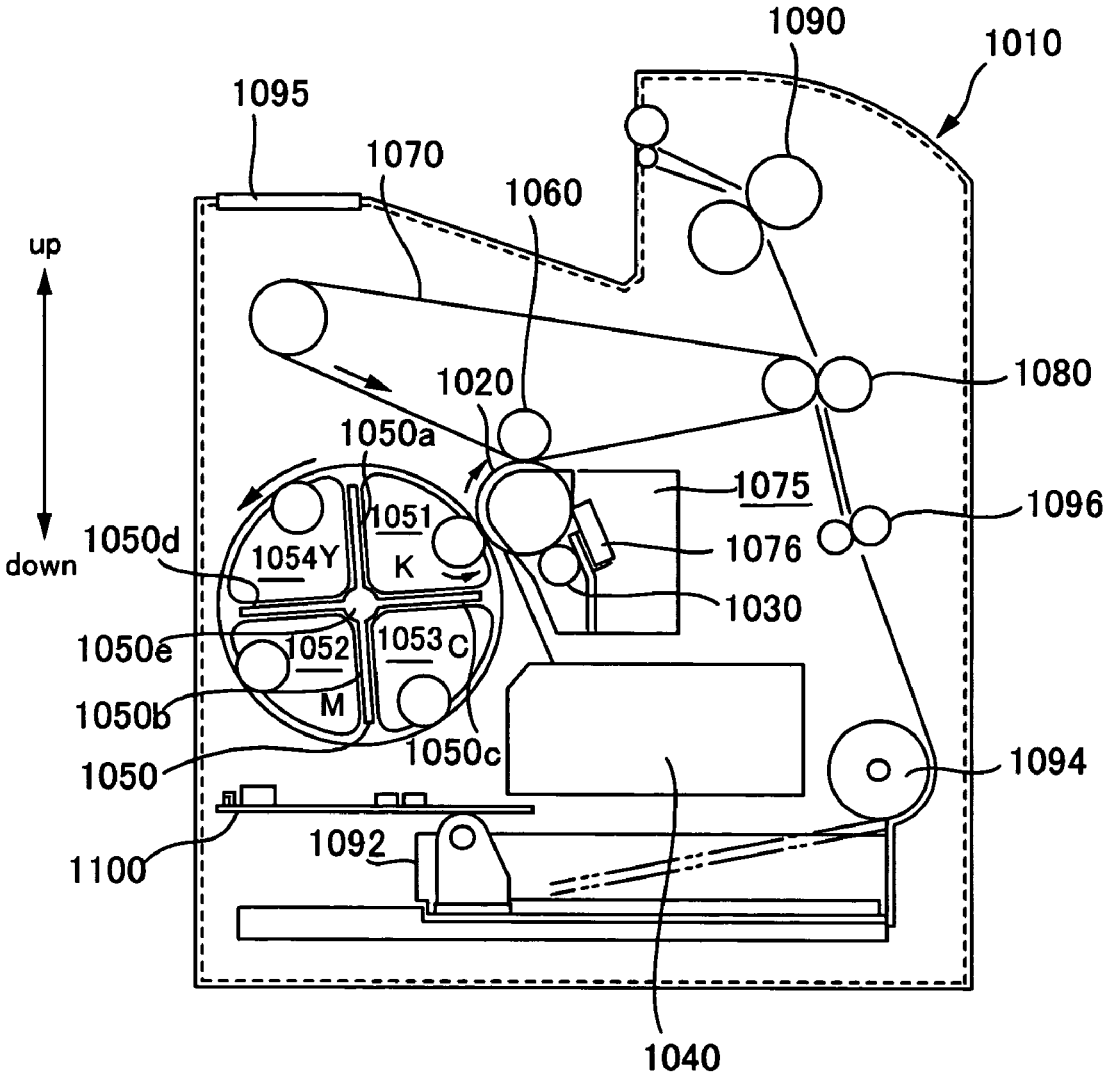
FIG. 12 is a diagram showing main structural components that structure a printer 1010.

Next, using FIG. 12, an outline of a laser beam printer 1010 (referred to also as "printer 1010" below), which is an example of an image forming apparatus, is described. FIG. 12 is a diagram showing main structural components constructing the printer 1010. It should be noted that in FIG. 12, the arrow indicates the vertical direction, and, for example, a paper supply tray 1092 is arranged at a lower section of the printer 1010, and a fusing unit 1090 is arranged at an upper section of the printer 1010.

<Example of an Overall Configuration of the Image Forming Apparatus>

As shown in FIG. 12, the printer 1010 according to the present embodiment includes a charging unit 1030, an exposing unit 1040, a rotating body 1050, a first transferring unit 1060, an intermediate transferring body 1070, and a cleaning unit 1075, all of which being arranged in the direction of rotation of a photoconductor 1020, which serves as an example of an image bearing body for bearing a latent image. The printer 1010 further includes a second transferring unit 1080, a fusing unit 1090, a displaying unit 1095 constructed of a liquid-crystal panel and serving as means for making notifications to the user etc., and a control unit 1100 for controlling these units etc. and managing the operations as a printer.

The photoconductor 1020 has a cylindrical conductive base and a photoconductive layer formed on the outer peripheral surface of the conductive base, and it is rotatable about its central axis. In the present embodiment, the photoconductor 1020 rotates clockwise, as shown by the arrow in FIG. 12.

The charging unit 1030 is a device for charging the photoconductor 1020. The exposing unit 1040 is a device for forming a latent image on the charged photoconductor 1020 by radiating a laser beam thereon. The exposing unit 1040 has, for example, a semiconductor laser, a polygon mirror, and an F-θ lens, and radiates a modulated laser beam onto the charged photoconductor 1020 according to image signals having been input from a not-shown host computer such as a personal computer or a word processor.

The rotating body 1050 is a device for developing the latent image formed on the photoconductor 1020 using black (K) toner contained in a black developing unit 1051, magenta (M) toner contained in a magenta developing unit 1052, cyan (C) toner contained in a cyan developing unit 1053, and yellow (Y) toner contained in a yellow developing unit 1054.

In the present embodiment, the rotating body 1050 rotates to allow the positions of the four developing units 1051, 1052, 1053, and 1054, which serve as an example of developing devices, to be moved. More specifically, the rotating body 1050 holds the four developing units 1051, 1052, 1053, and 1054 with four attach/detach sections 1050*a*, 1050*b*, 1050*c*, and 1050*d*, respectively, and the four developing units 1051, 1052, 1053, and 1054 can be rotated about a rotating shaft 1050*e* while maintaining their relative positions. A different one of the developing units is made to selectively oppose the photoconductor 1020 each time the photoconductor 1020 makes one revolution, thereby successively developing the latent image formed on the photoconductor 1020 using the toner T contained in each of the developing units 1051, 1052, 1053, and 1054 and serving as a example of developer. It should be noted that details on the developing units are described further below.

The first transferring unit 1060 is a device for transferring, onto the intermediate transferring body 1070, a single-color toner image formed on the photoconductor 1020. When toner images of four colors are successively transferred in a superposed manner, a full-color toner image is formed on the intermediate transferring body 1070. The intermediate transferring body 1070 is an endless belt that is driven to rotate at substantially the same circumferential speed as the photoconductor 1020. The second transferring unit 1080 is a device for transferring the single-color toner image, or the full-color toner image, formed on the intermediate transferring body 1070 onto a recording medium such as paper, film, and cloth.

The fusing unit 1090 is a device for fusing the single-color toner image or the full-color toner image, which has been transferred to the recording medium, onto the recording medium such as paper to make it into a permanent image.

The cleaning unit 1075 is a device that is provided between the first transferring unit 1060 and the charging unit 1030, that has a rubber cleaning blade 1076 made to abut against the surface of the photoconductor 1020, and that is for removing the toner remaining on the photoconductor 1020 by scraping it off with the cleaning blade 1076 after the toner image has been transferred onto the intermediate transferring body 1070 by the first transferring unit 1060.

Figure 13:
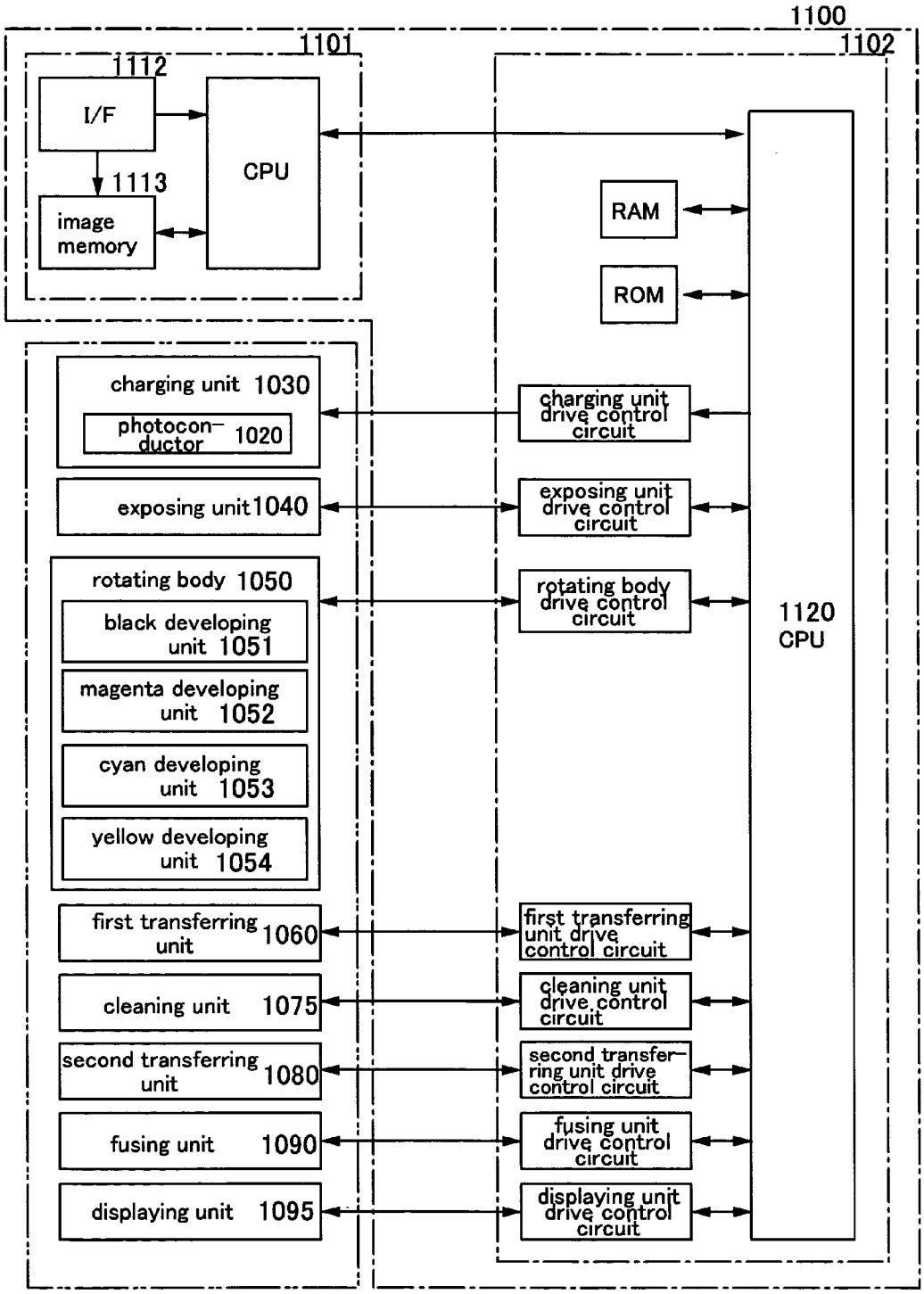
FIG. 13 is a block diagram showing a control unit 1100 of the printer 1010.

The control unit 1100 includes a main controller 1101 and a unit controller 1102 as shown in FIG. 13. Image signals are input to the main controller 1101, and according to instructions based on these image signals, the unit controller 1102 controls each of the above-mentioned units etc. to form an image.

<Example of Operations of the Image Forming Apparatus>

Next, operations of the printer 1010 structured as above are described, referring also to other structural components.

When image signals are input from the not-shown host computer to the main controller 1101 of the printer 1010 through an interface (I/F) 1112, then the photoconductor 1020, a developing roller that is provided in each developing unit, and the intermediate transferring body 1070 rotate under the control of the unit controller 1102 according to the instructions from the main controller 1101. While being rotated, the photoconductor 1020 is successively charged by the charging unit 1030 at a charging position.

With the rotation of the photoconductor 1020, the charged area of the photoconductor 1020 reaches an exposing position. A latent image that corresponds to the image information for the first color, for example, yellow Y, is formed in that area by the exposing unit 1040. The rotating body 1050 positions the yellow developing unit 1054, which contains yellow (Y) toner, at the developing position opposing the photoconductor 1020.

With the rotation of the photoconductor 1020, the latent image formed on the photoconductor 1020 reaches the developing position, and is developed with the yellow toner by the yellow developing unit 1054. Thus, a yellow toner image is formed on the photoconductor 1020.

With the rotation of the photoconductor 1020, the yellow toner image formed on the photoconductor 1020 reaches a first transferring position, and is transferred onto the intermediate transferring body 1070 by the first transferring unit 1060. At this time, a first transferring voltage, which is in an opposite polarity to the polarity to which the toner is charged, is applied to the first transferring unit 1060. It should be noted that, during this process, the second transferring unit 1080 is kept separated from the intermediate transferring body 1070.

By repeating the above-mentioned processes for the second, the third, and the fourth colors, toner images in four colors corresponding to the respective image signals are transferred to the intermediate transferring body 1070 in a superimposed manner. As a result, a full-color toner image is formed on the intermediate transferring body 1070.

With the rotation of the intermediate transferring body 1070, the full-color toner image formed on the intermediate transferring body 1070 reaches a second transferring position, and is transferred onto a recording medium by the second transferring unit 1080. It should be noted that the recording medium is carried from the paper supply tray 1092 to the second transferring unit 1080 via the paper-feed roller 1094 and resisting rollers 1096. During transferring operations, a second transferring voltage is applied to the second transferring unit 1080 and also the unit 1080 is pressed against the intermediate transferring body 1070.

The full-color toner image transferred onto the recording medium is heated and pressurized by the fusing unit 1090 and fused to the recording medium.

On the other hand, after the photoconductor 1020 passes the first transferring position, the toner adhering to the surface of the photoconductor 1020 is scraped off by the cleaning blade 1076 that is supported on the cleaning unit 1075, and the photoconductor 1020 is prepared for charging for the next latent image to be formed. The scraped-off toner is collected into a remaining-toner collector of the cleaning unit 1075.

Configuration of Control Unit

Next, with reference to FIG. 13, the configuration of the control unit 1100 will be described. A main controller 1101 of the control unit 1100 is connected to a host computer via the interface 1112 and has an image memory 1113 for storing image signals that have been input from the host computer.

The unit controller 1102 is electrically connected to each of the units in the apparatus body (i.e., the charging unit 1030, the exposing unit 1040, the rotating body 1050, the first transferring unit 1060, the cleaning unit 1075, the second transferring unit 1080, the fusing unit 1090, and the displaying unit 1095) and controls the units according to signals received from the main controller 1101 while detecting the state of each of the units by receiving signals from sensors provided in each unit.

Overview of Developing Unit

Figure 14:
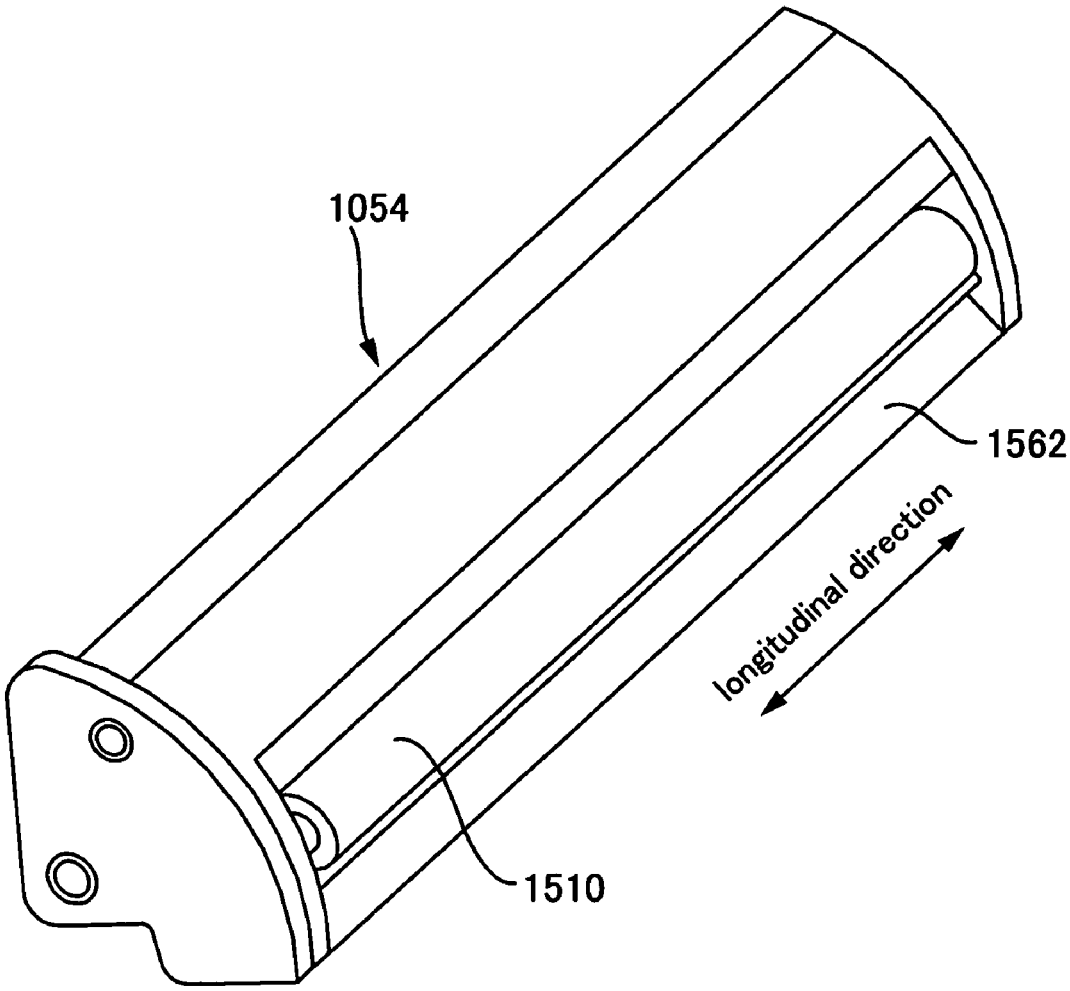
FIG. 14 is a conceptual diagram of a developing unit.
Figure 15:
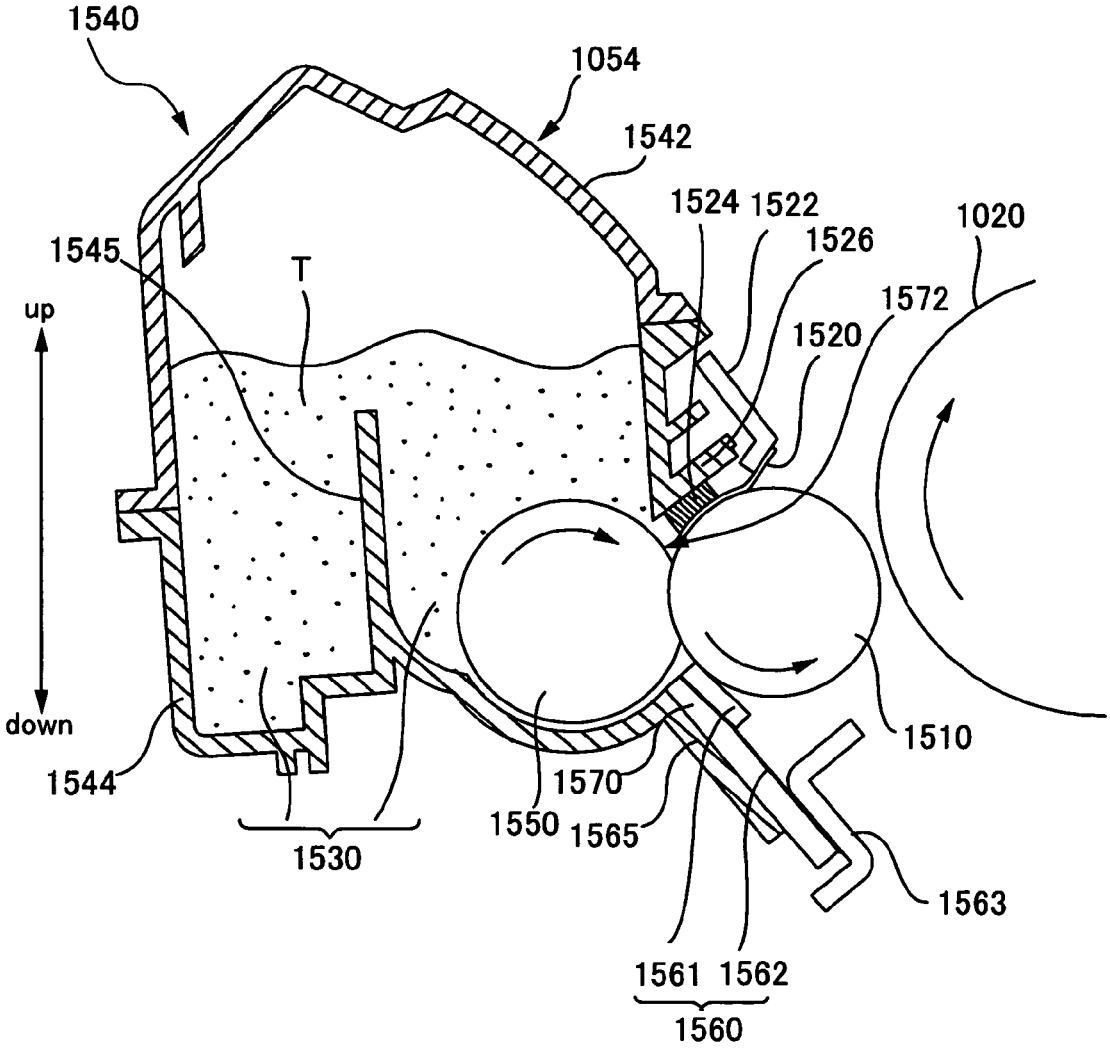
FIG. 15 is a section view showing main structural components of the developing unit.

Next, using FIG. 14 and FIG. 15, an overview of a developing unit will be described. FIG. 14 is a conceptual diagram of a developing unit. FIG. 15 is a section view showing main structural components of the developing unit. Note that the section view shown in FIG. 15 is a cross section of the developing unit bisected by a plane perpendicular to the longitudinal direction shown in FIG. 14. Further, in FIG. 15, the arrow indicates the vertical direction as in FIG. 12, and, for example, the central axis of the developing roller 1510 is located below the central axis of the photoconductor 1020. Further, in FIG. 15, the yellow developing unit 1054 is shown to be in a state in which it is positioned at the developing position opposing the photoconductor 1020.

<Example of an Overall Configuration of the Developing Unit>

To the rotating body 1050, it is possible to attach: the black developing unit 1051 containing black (K) toner; the magenta developing unit 1052 containing magenta (M) toner; the cyan developing unit 1053 containing cyan (C) toner; and the yellow developing unit 1054 containing yellow (Y) toner. Since the configuration of the developing units is the same, explanation will be made only about the yellow developing unit 1054 below.

The yellow developing unit 1054 has, for example, the developing roller 1510 which serves as an example of a developer bearing body, a toner collecting member 1520, a toner containing section 1530, a housing 1540, a toner supplying roller 1550, and a restriction blade 1560 which serves as an example of a charging member.

The developing roller 1510 bears toner T and delivers it to the developing position opposing the photoconductor 1020. The developing roller 1510 is made of metal and, for example, it is manufactured from aluminum alloy such as aluminum alloy 5056 or aluminum alloy 6063, or iron alloy such as STKM, and the roller 1510 is plated with, for example, nickel plating or chromium plating, as necessary. Further, as shown in FIG. 14, the developing roller 1510 is supported at both ends in its longitudinal direction and is rotatable about its central axis. As shown in FIG. 15, the developing roller 1510 rotates in the opposite direction (counterclockwise in FIG. 15) to the rotating direction of the photoconductor 1020 (clockwise in FIG. 15). The central axis of the roller 1510 is located below the central axis of the photoconductor 1020.

Further, as shown in FIG. 15, there is a gap between the developing roller 1510 and the photoconductor 1020 in a state where the yellow developing unit 1054 opposes the photoconductor 1020. That is, the yellow developing unit 1054 develops the latent image formed on the photoconductor 1020 in a non-contacting state. It should be noted that an alternating field is generated between the developing roller 1510 and the photoconductor 1020 upon development of the latent image formed on the photoconductor 1020.

The toner collecting member 1520 abuts against the developing roller 1510 to collect the toner T, which is on the developing roller 1510 that has passed the developing position, into the developing device without scraping it off, and also to prevent the toner T in the yellow developing unit 1054 from spilling out therefrom. The toner collecting member 1520 is a member made of, for example, polyethylene film. The toner collecting member 1520 is supported by a supporting metal plate 1522, and is attached to the housing 1540 via the supporting metal plate 1522. Note that the abutting position at which the toner collecting member 1520 abuts against the developing roller 1510 is situated above the central axis of the developing roller 1510.

Further, a sealing member 1524 is provided on one side of the toner collecting member 1520 opposite from the side of the developing roller 1510. The sealing member 1524 prevents the toner T from spilling from between the toner collecting member 1520 and an opposing member 1526 that is arranged in opposition to the toner collecting member 1520 on one side of the toner collecting member 1520 opposite from the side of the developing roller 1510. The sealing member 1524 also presses the toner collecting member 1520 against the developing roller 1510 with its elastic force. It should be noted that the opposing member 1526 forms a part of the housing 1540.

The housing 1540 is manufactured by welding together a plurality of integrally-molded housing sections, that is, an upper housing section 1542 and a lower housing section 1544. As shown in FIG. 15, the housing 1540 has an opening 1572 that opens toward the outside of the housing 1540. The above-mentioned developing roller 1510 is arranged from the outside of the housing 1540 with its peripheral surface facing the opening 1572 in such a state that a portion of the roller 1510 is exposed to the outside. The restriction blade 1560, which is described in detail below, is also arranged from the outside of the housing 1540 facing the opening 1572.

Further, the housing 1540 forms a toner containing section 1530 that is capable of containing toner T. The toner containing section 1530 may be provided with a stirring member for stirring the toner T. In the present embodiment, however, a stirring member is not provided in the toner containing section 1530 because each of the developing devices (i.e., the black developing unit 1051, the magenta developing unit 1052, the cyan developing unit 1053, and the yellow developing unit 1054) is rotated with the rotation of the rotating body 1050 and thereby the toner T in each developing unit is stirred.

The toner supplying roller 1550 is provided in the toner containing section 1530 described above and supplies the toner T contained in the toner containing section 1530 to the developing roller 1510. The toner supplying roller 1550 is made of, for example, polyurethane foam, and is made to abut against the developing roller 1510 in an elastically deformed state. The toner supplying roller 1550 is arranged at a lower section of the toner containing section 1530. The toner T contained in the toner containing section 1530 is supplied to the developing roller 1510 by the toner supplying roller 1550 at the lower section of the toner containing section 1530.

The toner supplying roller 1550 is rotatable about its central axis. The central axis of the toner supplying roller 1550 is situated lower than the central axis of rotation of the developing roller 1510. Further, the toner supplying roller 1550 rotates in the opposite direction (clockwise in FIG. 15) to the rotating direction of the developing roller 1510 (counterclockwise in FIG. 15). Note that the toner supplying roller 1550 has the function of supplying the toner T contained in the toner containing section 1530 to the developing roller 1510 as well as the function of stripping off the toner T remaining on the developing roller 1510 after development from the developing roller 1510.

Figure 16:
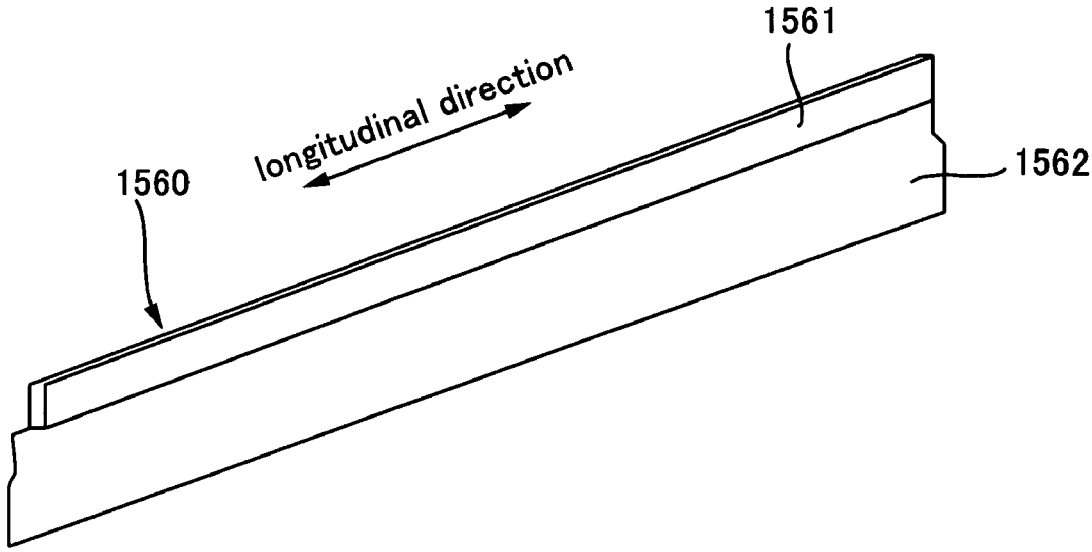
FIG. 16 is a perspective view of a restriction blade 1560.

The restriction blade 1560 restricts the thickness of the layer of the toner T bore by the developing roller 1510 and also gives charge to the toner T bore by the developing roller 1510. As shown in FIG. 16, this restriction blade 1560 has a rubber section 1561, which serves as an example of an abutting section, and a rubber-supporting section 1562, which serves as an example of a supporting section.

The rubber section 1561 is made of, for example, silicone rubber or urethane rubber. The rubber-supporting section 1562 is a thin metal plate that is made of, for example, phosphor bronze or stainless steel, and that has a springy characteristic. The rubber section 1561 is supported by the rubber-supporting section 1562. The rubber-supporting section 1562 is attached to the housing 1540 by means of a blade-supporting metal plate 1563. The side of one end of the rubber-supporting section 1562 is held between the blade-supporting metal plate 1563 and a blade-backing member 1570. The rubber section 1561 is pressed against the developing roller 1510 by the elastic force caused by bending of the rubber-supporting section 1562. Further, the blade-backing member 1570 is provided on one side of the restriction blade 1560 opposite from the side of the developing roller 1510. It should be noted that details on the blade-backing member 1570 will be described further below.

The end of the restricting blade 1560 opposite to the end that is being supported by the blade-supporting metal plate 1563, i.e., the tip end, is not placed in contact with the developing roller 1510; rather, a section at a predetermined distance from the tip end contacts, with some breadth, the developing roller 1510. That is, the restriction blade 1560 does not abut against the developing roller 1510 at its edge, but abuts against the roller 1510 near its central portion. Further, the restriction blade 1560 is arranged such that its tip end faces towards the upstream side of the rotating direction of the developing roller 1510, and thus, makes a so-called counter-abutment with respect to the roller 1510. It should be noted that the abutting position at which the rubber section 1561 abuts against the developing roller 1510 is below the position of the center of rotation (i.e., the central axis) of the developing roller 1510 and is also below the central axis of the toner supplying roller 1550.

<Example of Operations of the Developing Unit>

In the yellow developing unit 1054 structured as above, the toner supplying roller 1550 supplies the toner T contained in the toner containing section 1530 to the developing roller 1510. With the rotation of the developing roller 1510, the toner T, which has been supplied to the developing roller 1510, reaches the abutting position of the restriction blade 1560; then, as the toner T passes the abutting position, the toner is electrically charged and its layer thickness is restricted. With further rotation of the developing roller 1510, the toner T on the developing roller 1510, whose layer thickness has been restricted, reaches the developing position opposing the photoconductor 1020; then, under the alternating field, the toner T is used at the developing position for developing the latent image formed on the photoconductor 1020. With further rotation of the developing roller 1510, the toner T on the developing roller 1510, which has passed the developing position, passes the toner collecting member 1520 and is collected into the developing unit without being scraped off by the toner collecting member 1520. Then, the toner T that still remains on the developing roller 1510 can be stripped off by the toner supplying roller 1550.

Example of Sealing Member and Manufacturing Method Therefor

Figure 17:
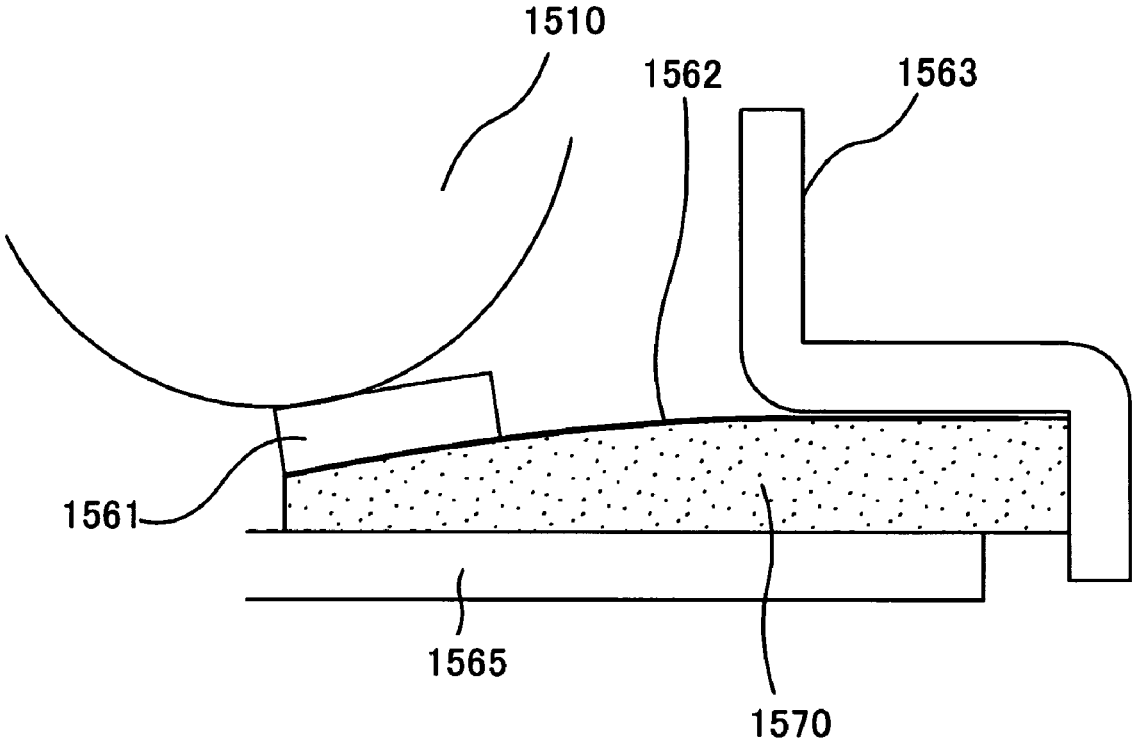
FIG. 17 is a diagram showing a configuration of the periphery of a blade-backing member 1570.

The blade-backing member 1570, which serves as an example of a sealing member, and an example of a manufacturing method therefor are described below. FIG. 17 is a diagram showing a structure of the blade-backing member 1570 and its periphery.

<Sealing Member>

As shown in FIG. 17, the blade-backing member 1570 is provided, in a compressed state, between the rubber-supporting section 1562 and an opposing member 1565 which is arranged in opposition to the rubber-supporting section 1562 on one side of the rubber-supporting section 1562 opposite from the side of the developing roller 1510. The blade-backing member 1570 prevents the toner T from entering in between the rubber-supporting section 1562 and the opposing member 1565, stabilizes the elastic force caused by bending of the rubber-supporting section 1562, and also presses the rubber section 1561 against the developing roller 1510 by applying force to the rubber section 1561 in the direction of the developing roller 1510 from right behind the rubber section 1561. Therefore, the blade-backing member 1570 serves as to cause the rubber section 1561 to abut against the developing roller 1510 more evenly. It should be noted that the opposing member 1565 structures a part of the housing 1540.

The blade-backing member 1570 is made of a foam including both closed cells and open cells. It should be noted that a"closed cell" refers to a type of air pocket (cell) in which the cells are independent of one another; each of the cells is completely partitioned by cell walls, and therefore toner cannot easily move into other cells. On the other hand, an "open cell" refers to a type of cell in which the cells are not completely partitioned but are partially continuous with other cells, or a type of cell in which some of the cell walls have been broken, thereby allowing toner to move into other cells easily.

The foam including both closed cells and open cells is obtained by foaming a mixture including, for example, rubber, a foaming agent, and a vulcanizing agent. In the present embodiment, ethylene-propylene-diene rubber (EPDM) is used as the rubber for the mixture.

The rubber mentioned above, however, is not limited to ethylene-propylene-diene rubber (EPDM). For example, synthetic rubber other than ethylene-propylene-diene rubber (EPDM) (such as chloroprene rubber, butadiene rubber, styrene-butadiene rubber, and isoprene rubber) and natural rubber may be used. These substances are macromolecular substances and are polymers having elastic characteristics. Further, the rubber described in the claims is a macromolecular substance. It should be noted that a single type of rubber may be used, or two or more types of rubbers may be used in combination. It is possible to obtain fine and uniform cells when ethylene-propylene-diene rubber (EPDM) is used.

Sodium acid carbonate, ammonium carbonate, and ammonium acid carbonate are examples of the foaming agent. Sulfur, sulfur compounds, selenium, and magnesium oxide are examples of the vulcanizing agent. It should be noted that it is possible to add, for example, various kinds of additives such as an antioxidant, a coloring agent, a foaming aid, a slip additive, and a flame retardant to the mixture, if necessary.

When giving consideration to an objective of preventing the toner T from spilling from the sealing member, it is preferable to use, as the blade-backing member 1570, a sealing member made of a foam including only closed cells. This is because when a sealing member made of a foam including only closed cells is used, the toner T cannot easily move from one cell to other cells, as described above.

On the other hand, when giving consideration to an objective of lessening the compression-repulsion force of the blade-backing member 1570 exerted on the restriction blade 1560, it is preferable to use, as the blade-backing member 1570, a sealing member made of a foam including only open cells. The reason to this is that, since the cell walls in a sealing member made of a foam including only open cells are broken, the compression force necessary for compressing the sealing member for a predetermined amount can be made smaller than that necessary for compressing a sealing member made of a foam including only closed cells, whose cell walls are not broken, and therefore, the compression-repulsion force, which corresponds to the compression force, also becomes small.

In order to achieve both objectives, a sealing member made of a foam including both closed cells and open cells is used as the blade-backing member 1570 of the present embodiment. In this way, it is possible to prevent the toner T from spilling from the blade-backing member 1570 and also lessen the compression-repulsion force of the blade-backing member 1570 exerted on the restriction blade 1560.

<Example of a Method for Manufacturing the Sealing Member>

The blade-backing member 1570 made of a foam including both closed cells and open cells can be manufactured according to processes given below.

A mixture including ethylene-propylene-diene rubber (EPDM), a foaming agent, a vulcanizing agent, etc. is melt-blended uniformly in an apparatus such as a mixer. The melt-blended mixture is then formed into a predetermined shape, such as into a sheet, using an apparatus such as a roller or an extruder. Then, the mixture formed into a sheet is heated to cause vulcanization and foaming. In this way, it is possible to manufacture a foam including a multitude of closed cells from the mixture.

Next, the foam including a multitude of closed cells is pressurized with a roller, for example, to break some of the closed cells and make those broken cells continuous. In this way, it is possible to manufacture a foam including both closed cells and open cells from the foam including a multitude of closed cells. Then, the foam including both closed cells and open cells is cut into a predetermined size.

In this way, it is possible to obtain, from a mixture including ethylene-propylene-diene rubber (EPDM), a foaming agent, a vulcanizing agent, etc., the blade-backing member 1570 made of a foam including both closed cells and open cells.

Effect of Preventing Developer from Spilling Achieved by the Sealing Member According to the Present Invention As described above, the blade-backing member 1570 is made of a foam obtained by foaming a mixture including at least rubber and a foaming agent. In this way, it is possible to prevent the toner T from spilling from the blade-backing member 1570.

More specifically, as described in the section of the "Description of the Related Art", urethane foam has been conventionally used as the blade-backing member 1570 for preventing the toner T from spilling. With urethane foam, however, toner T cannot be prevented from spilling in some circumstances. That is, as shown in FIG. 18, since the size of the cells of urethane foam, which is one type of foam, is large (as indicated by "A" in FIG. 18) and the walls between cells are thick, the toner T may pass through the cells and spill from the blade-backing member 1570 if, for example, an unexpected impact is applied to the urethane foam.

In view of the above, the blade-backing member 1570 of the present embodiment is made of a foam obtained by foaming a mixture including at least rubber (such as ethylene-propylene-diene rubber) and a foaming agent. With the foam obtained in this way, as shown in FIG. 19, the size of the cells is small (as indicated by "A" in FIG. 19) and the walls between cells are thin.

By making the walls thin, the sealing member can easily deform in structure when the sealing member is compressed, and thus, the cells can gather together when the sealing member is in a compressed state. Therefore, by making the cell size small and the walls between cells thin, it becomes difficult for the toner T to pass through the cells, and thus, it becomes possible to prevent the toner from spilling from the blade-backing member 1570.

Figure 18:
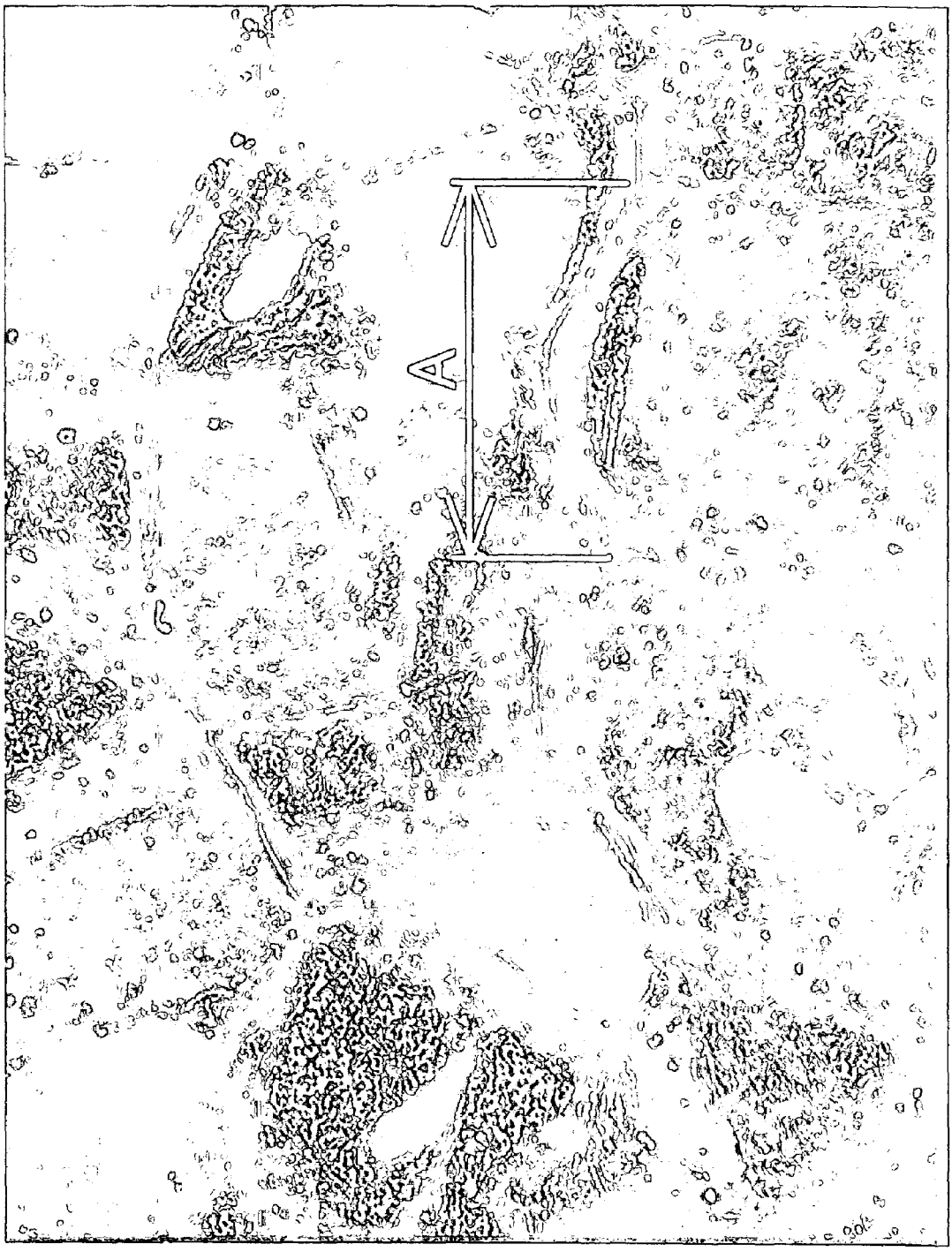
FIG. 18 is a photomicrograph of a sealing member made of urethane foam observed with a microscope.
Figure 19:
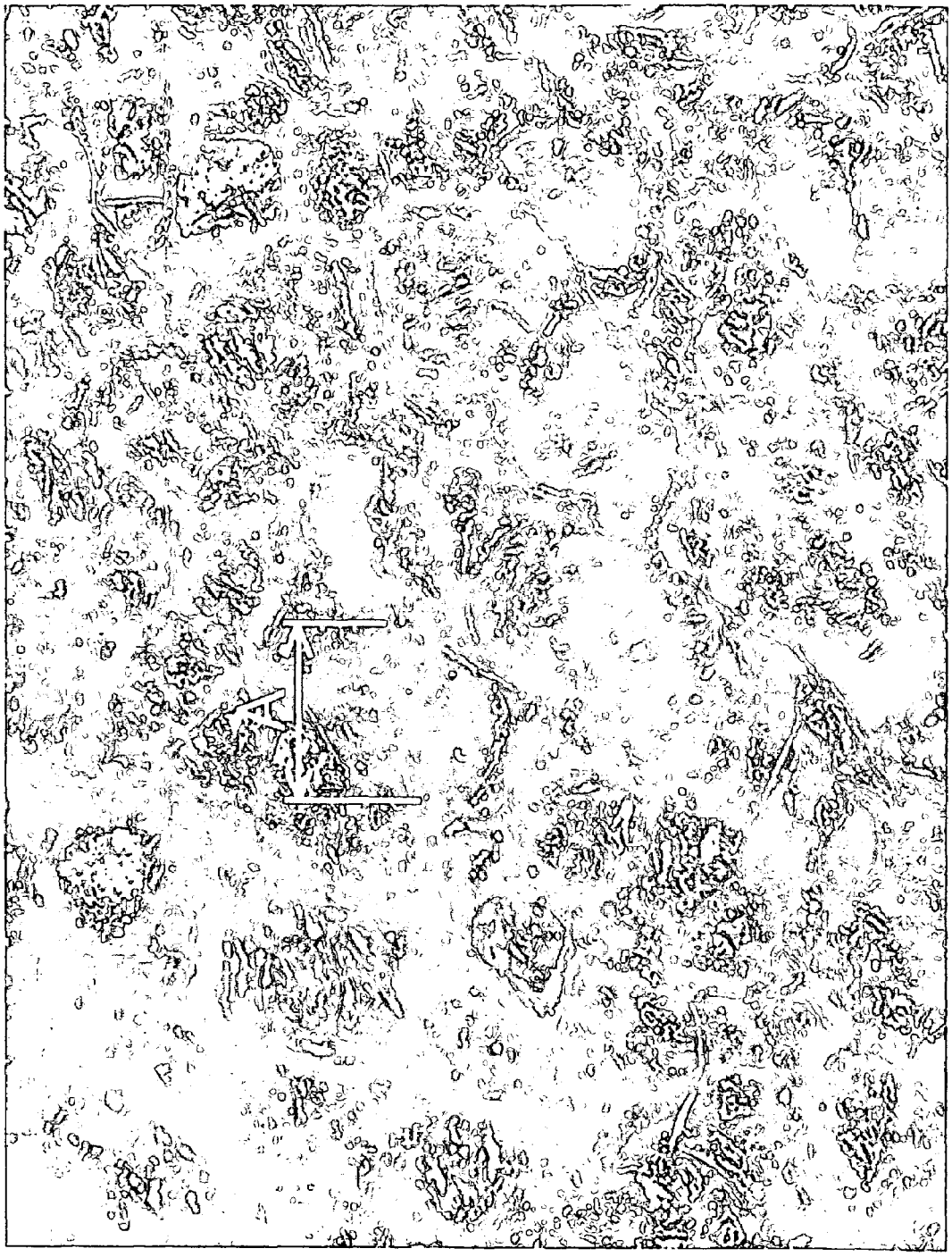
FIG. 19 is a photomicrograph of the blade-backing member 1570 according to the present embodiment.

It should be noted that FIG. 18 is a photomicrograph of the sealing member made of urethane foam observed with a microscope, and FIG. 19 is a photomicrograph of the blade-backing member 1570 according to the present embodiment. FIG. 18 and FIG. 19 have been observed at the same magnification.

As described above, by making the blade-backing member 1570 out of a foam obtained by foaming a mixture including at least rubber and a foaming agent, it is possible to prevent the toner T from spilling from the blade-backing member 1570.

Other Considerations

The present invention relates to a sealing member (such as the blade-backing member 1570) for preventing the developer (such as the toner T) from spilling.

Further, the present invention relates to a method for manufacturing a sealing member (such as the blade-backing member 1570) made of a foam for preventing the developer (such as the toner T) from spilling.

Further, the present invention relates to a developing device (such as the developing unit 1051, 1052, 1053, or 1054) comprising: a developer bearing body (such as the developing roller 1510) for bearing developer (such as the toner T); an abutting member (such as the restriction blade 1560) that abuts against the developer bearing body; an opposing member (such as the opposing member 1565) that is arranged in opposition to the abutting member on one side of the abutting member opposite from the side of the developer bearing body; and a sealing member (such as the blade-backing member 1570)for preventing the developer from spilling from between the abutting member and the opposing member.

It should be noted that in the foregoing embodiment, the sealing member was a blade-backing member 1570 provided in each of the developing units 1051, 1052, 1053, and 1054. This, however, is not a limitation.

For example, the sealing member may be provided on the remaining-toner collector of the cleaning unit 1075.

Further, in the foregoing embodiment, in the step of manufacturing a foam including both closed cells and open cells from a foam including only a multitude of closed cells, some of the closed cells were broken by applying pressure with, for example, a roller to make the broken cells continuous among each other. This, however, is not a limitation.

For example, some of the closed cells may be broken using, for example, a needle. Further, it is also possible to use two types of foaming agents—a foaming agent in which the temperature for foaming the mixture is low (referred to as "first foaming agent") and a foaming agent in which the temperature for foaming the mixture is high (referred to as "second foaming agent")—, manufacture a foam including only a multitude of closed cells by using the first foaming agent, and then break some of the closed cells by using the second foaming agent.

Further, in the foregoing embodiment, the foam included both closed cells and open cells. This, however, is not a limitation.

For example, the foam may include only closed cells.

However, when a sealing member made of a foam including only closed cells is used in situations where the rigidity of members (for example, the restriction blade 1560 and the opposing member 1565) that hold the sealing member is small, there is a possibility that compression of the sealing member is insufficient and the sealing ability of the sealing member is impaired. On the other hand, with a sealing member made of a foam including both closed cells and open cells, the compression force necessary for compressing the sealing member for a predetermined amount can be made smaller than that necessary for compressing a sealing member made of a foam including only closed cells. Therefore, it is possible to solve the problem of the compression of the sealing member being insufficient, and it becomes possible to prevent the sealing ability of the sealing member from being impaired.

Therefore, the foregoing embodiment is more preferable.

Further, in the foregoing embodiment, the abutting member served as a restriction blade 1560 for charging the toner T bore by the developing roller 1510; and the sealing member was a blade-backing member 1570 provided in a state compressed between the restriction blade 1560 and the opposing member 1565. This, however, is not a limitation.

For example, the abutting member may be the toner collecting member 1520, and the sealing member may be the sealing member 1524 provided in a state compressed between the toner collecting member 1520 and the opposing member 1526.

However, in a situation where the abutting member serves as the restriction blade 1560 for charging the toner T bore by the developing roller 1510 and the sealing member is the blade-backing member 1570 provided in a state compressed between the restriction blade 1560 and the opposing member 1565, a compression-repulsion force is applied from the blade-backing member 1570, which is being compressed, to the restriction blade 1560. Since the restriction blade 1560 is an element for charging the toner T bore by the developing roller 1510 as described above, problems such as deterioration of the toner T may occur if the compression-repulsion force is too large. On the other hand, by using a blade-backing member 1570 made of a foam including both closed cells and open cells, it becomes possible to reduce the compression-repulsion force applied from the blade-backing member 1570 to the restriction blade 1560, and thereby solve the problems such as deterioration of the toner T.

Therefore, the foregoing embodiment is more preferable.

Further, in the foregoing embodiment, the restriction blade 1560 included a rubber section 1561 that abuts against the developing roller 1510 and a rubber-supporting section 1562 for supporting the rubber section 1561; and the blade-backing member 1570 was provided in a state compressed between the rubber-supporting section 1562 and the opposing member 1565. This, however, is not a limitation.

For example, the restriction blade 1560 does not have to have a rubber-supporting section.

However, in a developing unit (1051, 1052, 1053, or 1054) in which the restriction blade 1560 includes a rubber-supporting section 1562 and the blade-backing member 1570 is provided in a state compressed between the rubber-supporting section 1562 and the opposing member 1565, a compression-repulsion force is applied from the blade-backing member 1570 to the rubber-supporting section 1562, and the problem involving deterioration of the toner T, which is charged by the rubber section 1561, becomes more significant.

The foregoing embodiment is therefore more preferable in terms that the effect of being able to reduce the compression-repulsion force from the blade-backing member 1570 to the restriction blade 1560 can be achieved more advantageously by using a blade-backing member 1570 made of a foam including both closed cells and open cells.

Further, in the foregoing embodiment, the abutting position where the rubber section 1561 abuts against the developing roller 1510 was below the position of the center of rotation of the developing roller 1510. This, however, is not a limitation.

For example, the abutting position where the rubber section 1561 abuts against the developing roller 1510 may be above the rotation-center position of the developing roller 1510.

However, in a developing unit 1051, 1052, 1053, or 1054 in which the abutting position where the rubber section 1561 abuts against the developing roller 1510 is below the position of the center of rotation of the developing roller 1510, the restriction blade 1560 charges the toner T bore on the developing roller 1510 through a so-called "downward restriction". In such a situation, the toner T is likely to gather around the blade-backing member 1570, and the possibility of the toner T spilling from the blade-backing member 1570 becomes even higher when a pressure is applied to a portion of the gathered toner T.

The foregoing embodiment is therefore more preferable in terms that the effect of the present invention, that is, the effect of being able to prevent the toner T from spilling from the blade-backing member 1570, can be achieved more advantageously.

OTHER EMBODIMENTS

In the foregoing, an image forming apparatus etc. according to the present invention was described according to the above-described embodiments thereof. However, the foregoing embodiments of the invention are for the purpose of facilitating understanding of the present invention and are not to be interpreted as limiting the present invention. The present invention can be altered and improved without departing from the gist thereof, and needless to say, the present invention includes its equivalents.

In the foregoing embodiments, an intermediate transferring type full-color laser beam printer was described as an example of the image forming apparatus, but the present invention is also applicable to various other types of image forming apparatuses, such as full-color laser beam printers that are not of the intermediate transferring type, monochrome laser beam printers, copying machines, and facsimiles.

Further, in the foregoing embodiments, an image forming apparatus provided with a rotary-type developing device was described as an example. This, however, is not a limitation, and the present invention is applicable to, for example, image forming apparatuses provided with tandem-type developing devices.

Further, in the foregoing embodiments, the photoconductor, as an image bearing body, was described as having a structure in which a photoconductive layer was provided on the outer peripheral surface of a cylindrical, conductive base. This, however, is not a limitation. The photoconductor can be, for example, a so-called photoconductive belt structured by providing a photoconductive layer on a surface of a belt-like conductive base.

<<<Configuration of Image Forming System etc.>>>

Next, an embodiment of an image forming system, which serve as an example of an embodiment of the present invention, is described with reference to the drawings.

Figure 20:
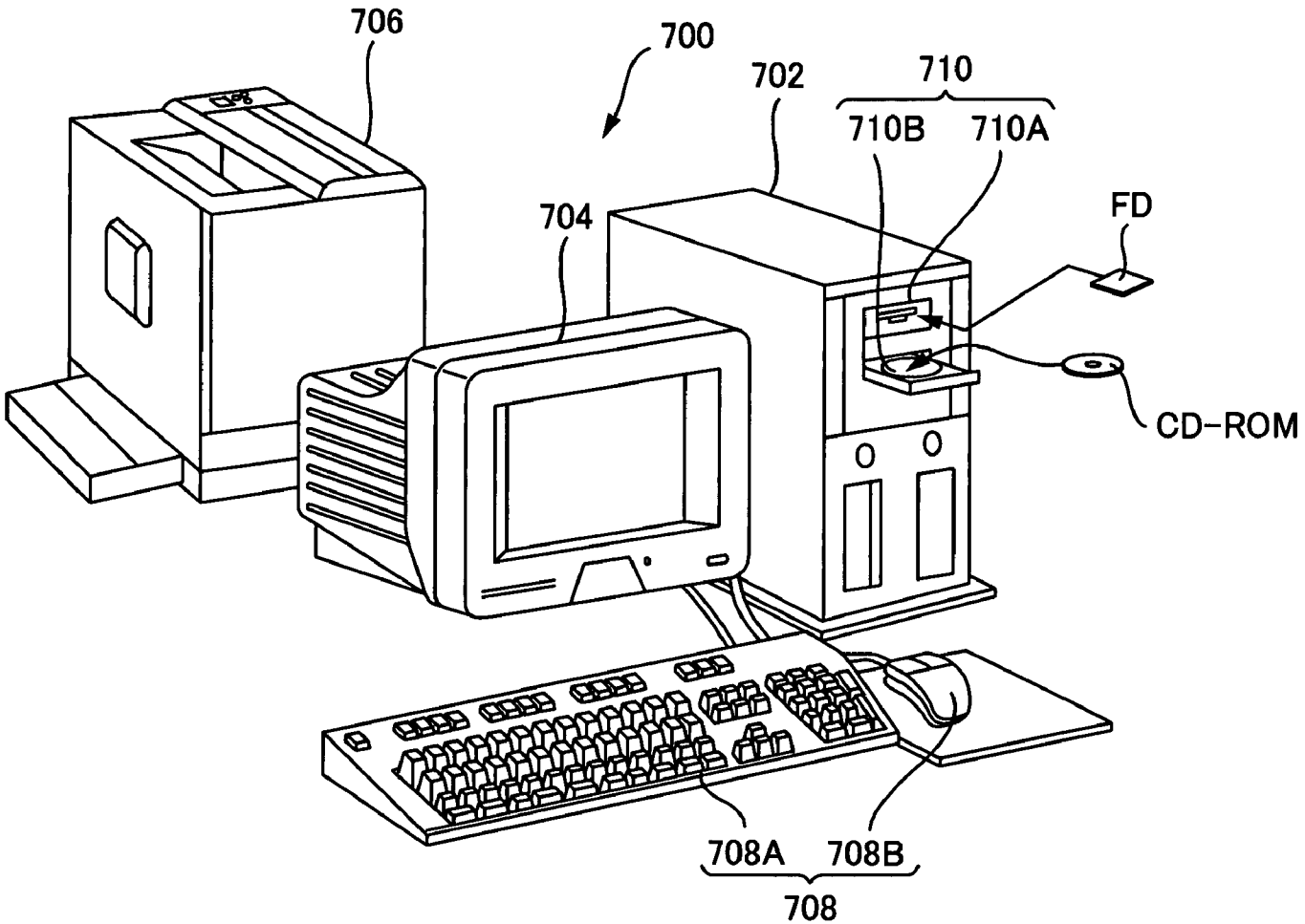
FIG. 20 is an explanatory drawing showing an external structure of an image forming system.

FIG. 20 is an explanatory drawing showing an external structure of an image forming system. The image forming system 700 comprises a computer 702, a display device 704, a printer 706, an input device 708, and a reading device 710. In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 706. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and other devices such as an MO (magneto optical) disk drive device or a DVD (digital versatile disk) may be used.

Figure 21:
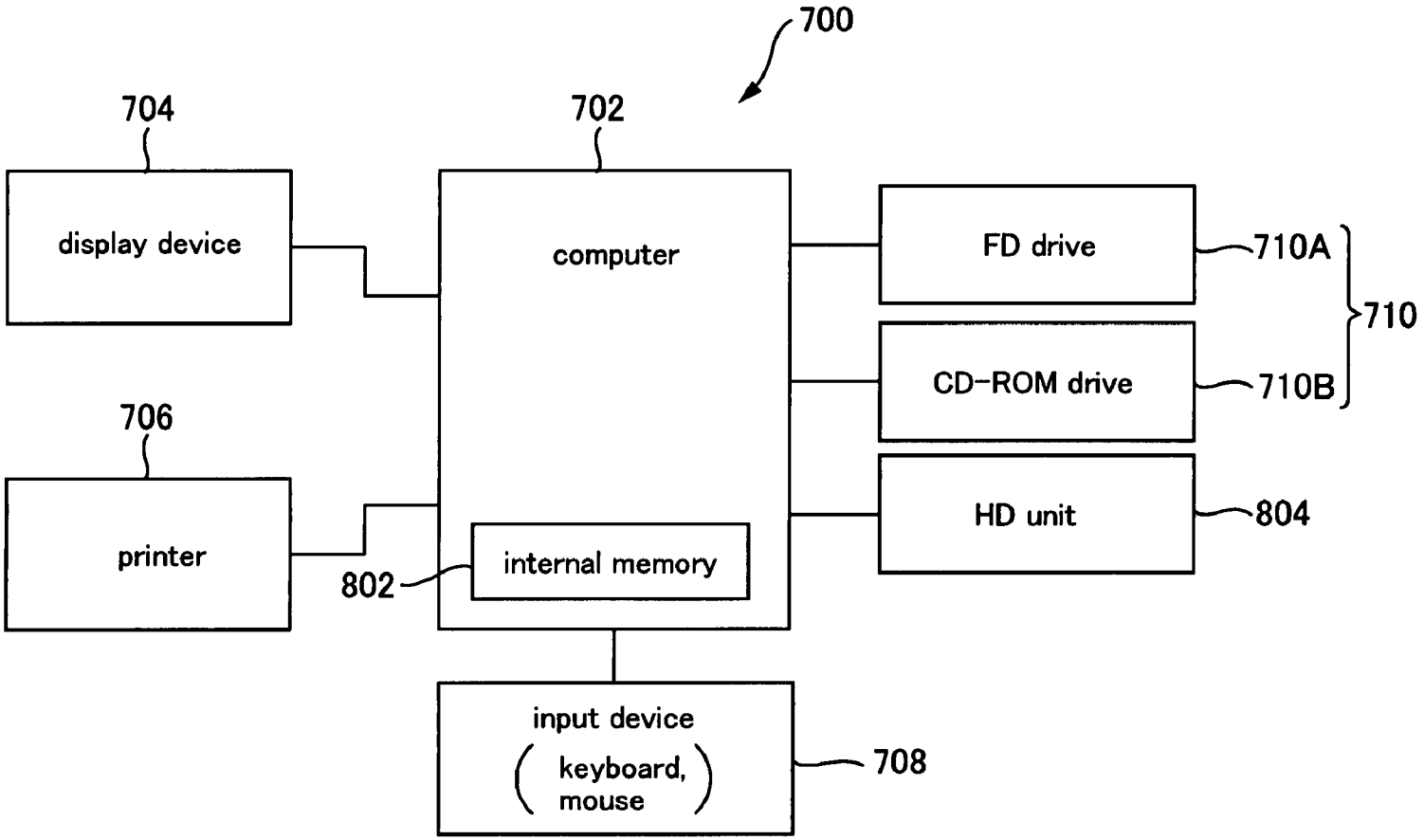
FIG. 21 is a block diagram showing a configuration of the image forming system shown in FIG. 20.

FIG. 21 is a block diagram showing a configuration of the image forming system shown in FIG. 20. Further provided are an internal memory 802, such as a RAM inside the housing accommodating the computer 702, and an external memory such as a hard disk drive unit 804.

It should be noted that in the above description, an example in which the image forming system is structured by connecting the printer 706 to the computer 702, the display device 704, the input device 708, and the reading device 710 was described, but this is not a limitation. For example, the image forming system can be made of the computer 702 and the printer 706, and the image forming system does not have to comprise any one of the display device 704, the input device 708, and the reading device 710.

Further, for example, the printer 706 can have some of the functions or mechanisms of the computer 702, the display device 704, the input device 708, and the reading device 710. As an example, the printer 706 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

What is claimed is:

1. A developing device comprising:

a developer container for containing developer;

a developer bearing body for bearing said developer;

a charging member for charging the developer bore by said developer bearing body by abutting against said developer bearing body;

a supporting member for supporting said charging member; and a sealing member that is for preventing the developer from spilling from said developer container and that is provided in a state in which the side of one end thereof is compressed by said developer container and said charging member and the side of the other end thereof is compressed by said developer container and said supporting member, wherein a degree of compression of said sealing member on said side of the other end is smaller than a degree of compression of said sealing member on said side of one end.

2. A developing device according to claim 1, wherein at a position corresponding to said side of the other end of said sealing member, the rigidity of said supporting member is smaller than the rigidity of said developer container.

3. A developing device according to claim 1, wherein said supporting member is fixed to said developing device at both ends of said supporting member in its longitudinal direction.

4. A developing device according to claim 1, wherein:

said charging member includes an elastic section and a supporting section that supports said elastic section at the side of one end thereof and that has a fulcrum of flexure on the side of the other end thereof;

said supporting member supports said supporting section at said side of the other end; and said supporting section bends, with said fulcrum of flexure acting as a fulcrum, to make said elastic section abut against said developer bearing body at an abutting section and to charge the developer bore by said developer bearing body.

5. A developing device according to claim 4, wherein:

said supporting section is fixed to said supporting member at a predetermined fixing point; and said fixing point serves as said fulcrum of flexure.

6. A developing device according to claim 4, wherein said sealing member is provided, on a side of said charging member opposite from the side of said developer bearing body, extending at least from a position corresponding to said fulcrum of flexure to a position corresponding to said abutting section.

7. A developing device according to claim 4, wherein said supporting section is held between said supporting member and said sealing member at said fulcrum of flexure.

8. A developing device according to claim 4, wherein said supporting section is fixed to said supporting member through welding.

9. A developing device comprising:

a developer container for containing developer;

a developer bearing body for bearing said developer;

a charging member for charging the developer bore by said developer bearing body by abutting against said developer bearing body;

a supporting member for supporting said charging member; and a sealing member that is for preventing the developer from spilling from said developer container and that is provided in a state in which the side of one end thereof is compressed by said developer container and said charging member and the side of the other end thereof is compressed by said developer container and said supporting member, wherein, a degree of compression of said sealing member on said side of the other, end is smaller than a degree of compression of said sealing member on said side of one end;

at a position corresponding to said side of the other end of said sealing member, the rigidity of said supporting member is smaller than the rigidity of said developer container;

said supporting member is fixed to said developing device at both ends of said supporting member in its longitudinal direction;

said charging member includes an elastic section and a supporting section that supports said elastic section at the side of one end thereof and that has a fulcrum of flexure on the side of the other end thereof;

said supporting member supports said supporting section at said side of the other end;

said supporting section bends, with said fulcrum of flexure acting as a fulcrum, to make said elastic section abut against said developer bearing body at an abutting section and to charge the developer bore by said developer bearing body;

said supporting section is fixed to said supporting member at a predetermined fixing point;

said fixing point serves as said fulcrum of flexure;

said sealing member is provided, on a side of said charging member opposite from the side of said developer bearing body, extending at least from a position corresponding to said fulcrum of flexure to a position corresponding to said abutting section;

said supporting section is held between said supporting member and said sealing member at said fulcrum of flexure; and said supporting section is fixed to said supporting member through welding.

10. An image forming apparatus comprising a developing device that includes:

a developer container for containing developer;

a developer bearing body for bearing said developer;

a charging member for charging the developer bore by said developer bearing body by abutting against said developer bearing body;

a supporting member for supporting said charging member; and a sealing member that is for preventing the developer from spilling from said developer container and that is provided in a state in which the side of one end thereof is compressed by said developer container and said charging member and the side of the other end thereof is compressed by said developer container and said supporting member, wherein a degree of compression of said sealing member on said side of the other end is smaller than a degree of compression of said sealing member on said side of one end.

11. An image forming system comprising:

a computer; and an image forming apparatus that is connectable to said computer and that has a developing device including:

a developer container for containing developer;

a developer bearing body for bearing said developer;

a charging member for charging the developer bore by said developer bearing body by abutting against said developer bearing body;

a supporting member for supporting said charging member; and a sealing member that is for preventing the developer from spilling from said developer container and that is provided in a state in which the side of one end thereof is compressed by said developer container and said charging member and the side of the other end thereof is compressed by said developer container and said supporting member, wherein a degree of compression of said sealing member on said side of the other end is smaller than a degree of compression of said sealing member on said side of one end.

* * * * *